US012037731B2

(12) United States Patent
Lee et al.

(10) Patent No.: US 12,037,731 B2
(45) Date of Patent: Jul. 16, 2024

(54) WASHING MACHINE FOR CONTROLLING DRYER, AND DRYER CONTROLLING METHOD PERFORMED BY WASHING MACHINE

(71) Applicant: SAMSUNG ELECTRONICS CO., LTD., Suwon-si (KR)

(72) Inventors: Hyojeong Lee, Suwon-si (KR); Kyusik Kim, Suwon-si (KR); Mikyoung Kim, Suwon-si (KR); Hyemin Cha, Suwon-si (KR); Dockjo Yang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 22 days.

(21) Appl. No.: 18/108,197

(22) Filed: Feb. 10, 2023

(65) Prior Publication Data

US 2023/0323584 A1 Oct. 12, 2023

Related U.S. Application Data

(63) Continuation of application No. PCT/KR2023/000357, filed on Jan. 9, 2023.

(30) Foreign Application Priority Data

Mar. 25, 2022 (KR) ..... 10-2022-0037502
Oct. 11, 2022 (KR) ..... 10-2022-0129960

(51) Int. Cl.
*D06F 34/05* (2020.01)
*D06F 33/50* (2020.01)
*D06F 58/32* (2020.01)

(52) U.S. Cl.
CPC ..... *D06F 34/05* (2020.02); *D06F 33/50* (2020.02); *D06F 58/32* (2020.02)

(58) Field of Classification Search
CPC ..... D06F 34/05; D06F 33/50; D06F 58/32; D06F 29/005; D06F 34/14;
(Continued)

(56) References Cited

U.S. PATENT DOCUMENTS 7,373,737 B2 5/2008 Lyu et al.
7,574,269 B2 * 8/2009 Cenedese ..... D06F 34/05 700/83

(Continued)

FOREIGN PATENT DOCUMENTS

CN 111321548 6/2020
CN 212611481 2/2021

(Continued)

OTHER PUBLICATIONS

International Search Report and Written Opinion of the International Searching Authority dated Apr. 28, 2023 for International Application No. PCT/KR2023/000357.

*Primary Examiner* — Nam V Nguyen
(74) *Attorney, Agent, or Firm* — STAAS & HALSEY LLP

(57) ABSTRACT

A washing machine includes a communication interface for wireless communication with a dryer; a user interface configured to receive a user's control input related to the dryer, and to output information related to the dryer; and at least one processor configured to determine whether a front surface of the dryer faces in a same direction as a front surface of the washing machine, and when it is determined that the front surface of the dryer faces in the same direction as the front surface of the washing machine, receive the user's control input related to the dryer through the user interface and transmit, to the dryer, a control command corresponding to the user's control input related to the dryer through the communication interface.

20 Claims, 21 Drawing Sheets

(58) Field of Classification Search
CPC .. D06F 2105/00; D06F 34/28; D06F 2103/00; D06F 2103/40
USPC ..... 340/3.1, 4.1
See application file for complete search history.

(56) References Cited

U.S. PATENT DOCUMENTS

| | | | | |
|---|---|---|---|---|
| 8,091,389 | B2 * | 1/2012 | Park | D06F 29/00 68/3 R |
| 9,745,682 | B2 | 8/2017 | Park et al. | |
| 10,275,052 | B2 | 4/2019 | Kang | |
| 10,311,257 | B2 | 6/2019 | Rubinshteyn | |
| 10,487,440 | B2 | 11/2019 | Jung | |
| 10,711,386 | B2 | 7/2020 | Jang et al. | |
| 10,745,841 | B2 * | 8/2020 | Yoon | G06F 3/0482 |
| 10,844,530 | B2 * | 11/2020 | Jones | D06F 29/005 |
| 11,591,735 | B2 * | 2/2023 | Allen | D06F 95/00 |
| 2004/0118008 | A1 * | 6/2004 | Jeong | D06F 34/04 34/445 |
| 2012/0153787 | A1 * | 6/2012 | Busalt | E05F 15/63 312/236 |
| 2018/0209084 | A1 * | 7/2018 | Chakravarty | D06F 58/04 |
| 2021/0269959 | A1 * | 9/2021 | Park | D06F 29/005 |
| 2021/0339159 | A1 | 11/2021 | Tanaka | |
| 2022/0275556 | A1 | 9/2022 | Song et al. | |

FOREIGN PATENT DOCUMENTS

| | | | |
|---|---|---|---|
| CN | 113957665 | | 1/2022 |
| JP | 6919107 | B2 | 8/2021 |
| KR | 10-2005-0048913 | A | 5/2005 |
| KR | 10-0519328 | | 10/2005 |
| KR | 10-0607273 | | 7/2006 |
| KR | 10-0607279 | | 7/2006 |
| KR | 10-0607280 | | 7/2006 |
| KR | 10-1319875 | | 10/2013 |
| KR | 10-2016-0068427 | A | 6/2016 |
| KR | 10-2017-0002891 | | 1/2017 |
| KR | 10-2021-0046299 | A | 4/2021 |
| KR | 10-2021-0114092 | | 9/2021 |
| KR | 10-2022-0010348 | A | 1/2022 |

* cited by examiner

WASHING MACHINE FOR CONTROLLING DRYER, AND DRYER CONTROLLING METHOD PERFORMED BY WASHING MACHINE

CROSS-REFERENCE TO RELATED APPLICATIONS

This application is a by-pass continuation application of International Application No. PCT/KR2023/000357, filed on Jan. 9, 2023, which is based on and claims priority to Korean Patent Application No. 10-2022-0037502, filed on Mar. 25, 2022, and Korean Patent Application No. 10-2022-0129960, filed on Oct. 11, 2022, in the Korean Intellectual Property Office. The disclosures of International Application No. PCT/KR2023/000357, Korean Patent Application No. 10-2022-0037502, and Korean Patent Application No. 10-2022-0129960, are incorporated by reference herein in their entireties.

BACKGROUND

1. Field

The disclosure relates to a washing machine for controlling a dryer, and a dryer controlling method performed by the washing machine.

2. Description of the Related Art

In general, a washing machine refers to a device capable of washing laundry such as clothes. A dryer refers to a device capable of drying laundry by using high-temperature dry air. With a recent increase in the number of households having both a washing machine and a dryer, the frequency of arranging and using the washing machine and the dryer adjacent to each other in an indoor space is increasing. By arranging the washing machine adjacent to the dryer, a user can move laundry from the washing machine to the dryer without carrying the laundry. For example, the dryer may be disposed in a vertically stacking structure with the washing machine, or may be disposed side by side with the washing machine.

For the convenience of users who use a washing machine and a dryer together, research on a method of controlling the operation of the dryer through the washing machine is being conducted. For example, the washing machine may be connected to the dryer through a wired communication interface, and may control the operation of the dryer through wired communication. However, in the case of a washing machine connected to a dryer through a wired communication interface, a defect occurrence rate due to defective parts and poor installation of the wired communication interface is high, and additional equipment may be required to arrange the wired communication interface for a neat appearance.

SUMMARY

Aspects of embodiments of the disclosure will be set forth in part in the description which follows and, in part, will be apparent from the description, or may be learned by practice of the presented embodiments.

According to an embodiment of the disclosure, a washing machine includes a communication interface for wireless communication with a dryer; a user interface configured to receive a user's control input related to the dryer, and to output information related to the dryer; and at least one processor configured to determine whether a front surface of the dryer faces in a same direction as a front surface of the washing machine, and when it is determined that the front surface of the dryer faces in the same direction as the front surface of the washing machine, receive the user's control input related to the dryer through the user interface and transmit, to the dryer, a control command corresponding to the user's control input related to the dryer through the communication interface.

According to an embodiment of the disclosure, the washing machine further includes a magnetic sensor arranged on an upper end of the washing machine at a location that corresponds to a magnetic body on a lower end of the dryer when the dryer is stacked on the washing machine, and the at least one processor is further configured to determine whether the front surface of the dryer faces in the same direction as the front surface of the washing machine based on a magnetic flux value sensed by the magnetic sensor.

According to an embodiment of the disclosure, the at least one processor is further configured to when the magnetic flux value sensed by the magnetic sensor is equal to or greater than a threshold value, determine that the front surface of the dryer faces in the same direction as the front surface of the washing machine, and when the magnetic flux value sensed by the magnetic sensor is less than the threshold value, determine that the front surface of the dryer faces in a different direction from the front surface of the washing machine.

According to an embodiment of the disclosure, the location at which the magnetic sensor is arranged on the upper end of the washing machine includes a non-metallic material.

According to an embodiment of the disclosure, the magnetic sensor includes at least one of a reed switch, a tunnel magnetoresistance (TMR) sensor, and a Hall sensor.

According to an embodiment of the disclosure, the washing machine further includes a first near field communication (NFC) chip arranged on an upper end of the washing machine at a location that corresponds to a second NFC chip on a lower end of the dryer when the dryer is stacked on the washing machine, and the at least one processor is further configured to determine whether the front surface of the dryer faces in the same direction as the front surface of the washing machine based on whether the first NFC chip recognizes the second NFC chip.

According to an embodiment of the disclosure, the first NFC chip includes one of an NFC reader and an NFC module, and the second NFC chip comprises one of an NFC tag and an NFC module.

According to an embodiment of the disclosure, the washing machine further includes a plurality of wireless communication antennas configured to respectively receive wireless communication signals transmitted by the dryer, and transmit the received wireless communication signals to the at least one processor, and the at least one processor is further configured to determine whether the front surface of the dryer faces in the same direction as the front surface of the washing machine based on a phase difference between the wireless communication signals respectively received from the plurality of wireless communication antennas.

According to an embodiment of the disclosure, when it is determined that the front surface of the dryer faces in the same direction as the front surface of the washing machine, the at least one processor is further configured to transmit a control command through the communication interface, to the dryer, for the dryer to prepare for drying, based on an operation course of the washing machine.

According to an embodiment of the disclosure, the at least one processor is further configured to output information, through the user interface, about the preparation for drying performed by the dryer according to the control command.

According to an embodiment of the disclosure, when it is determined that the front surface of the dryer faces in a different direction from the front surface of the washing machine, the at least one processor is further configured to perform at least one of an operation of outputting a message through the user interface for checking a direction of the dryer, and an operation of ignoring the user's control input related to the dryer received through the user interface.

According to an embodiment of the disclosure, the at least one processor is further configured to receive operation information of the dryer through the communication interface and output the operation information of the dryer through the user interface.

According to an embodiment of the disclosure, the washing machine further includes a magnetic sensor arranged to be adjacent to a magnetic body arranged on the dyer when the washing machine is disposed adjacent to the dryer in one direction, and the at least one processor is further configured to identify whether the front surface of the dryer faces in the same direction as the front surface of the washing machine based on a magnetic flux value sensed by the magnetic sensor.

According to an embodiment of the disclosure, a method performed by a washing machine includes determining whether a front surface of a dryer faces in a same direction as a front surface of the washing machine; and when it is determined that the front surface of the dryer faces in the same direction as the front surface of the washing machine, receiving a user's control input related to the dryer through a user interface of the washing machine, and transmitting, to the dryer, a control command corresponding to the user's control input related to the dryer through a communication interface of the washing machine.

According to an embodiment of the disclosure, the washing machine includes a magnetic sensor arranged on an upper end of the washing machine at a location corresponding to a magnetic body on a lower end of the dryer when the dryer is stacked on the washing machine, and the determining of whether the front surface of the dryer faces in the same direction as the front surface of the washing machine is based on a magnetic flux value sensed by the magnetic sensor.

According to an embodiment of the disclosure, the method further includes when the magnetic flux value sensed by the magnetic sensor is equal to or greater than a threshold value, determining that the front surface of the dryer faces in the same direction as the front surface of the washing machine; and when the magnetic flux value sensed by the magnetic sensor is less than the threshold value, determining that the front surface of the dryer faces in a different direction from the front surface of the washing machine.

According to an embodiment of the disclosure, the washing machine includes a first near field communication (NFC) chip on an upper end of the washing machine at a location that corresponds to a second NFC chip on a lower end of the dryer when the dryer is stacked on the washing machine, and the determining of whether the front surface of the dryer faces in the same direction as the front surface of the washing machine includes determining whether the first NFC chip recognizes the second NFC chip.

According to an embodiment of the disclosure, the washing machine includes a plurality of wireless communication antennas configured to respectively receive wireless communication signals transmitted by the dryer, and the determining of whether the front surface of the dryer 2000 faces in the same direction as the front surface of the washing machine is based on a phase difference between the wireless communication signals respectively received from the plurality of wireless communication antennas.

According to an embodiment of the disclosure, when it is determined that the front surface of the dryer faces in the same direction as the front surface of the washing machine, the method further comprises transmitting a control command through the communication interface, to the dryer, for the dryer to prepare for drying, based on an operation course of the washing machine.

According to an embodiment of the disclosure, when it is determined that the front surface of the dryer faces in a different direction from the front surface of the washing machine, the method further comprises at least one of an operation of outputting a message through the user interface for checking a direction of the dryer, and an operation of ignoring the user's control input related to the dryer received through the user interface.

BRIEF DESCRIPTION OF DRAWINGS

These and/or other embodiments of the disclosure will become apparent and more readily appreciated from the following description of the embodiments, taken in conjunction with the accompanying drawings of which.

DETAILED DESCRIPTION

Figure 1:
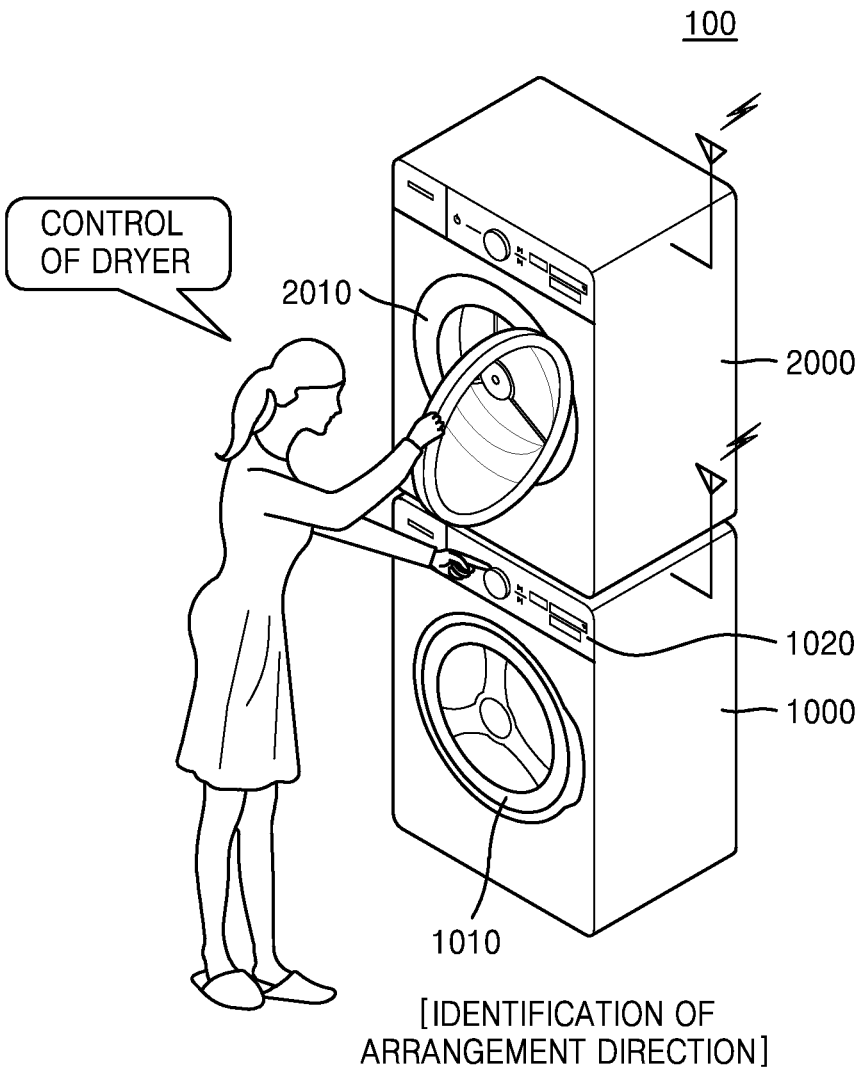
FIG. 1 is a view for explaining a washing system including a washing machine and a dryer, according to an embodiment of the disclosure.

Throughout the disclosure, the expression "at least one of a, b or c" indicates only a, only b, only c, both a and b, both a and c, both b and c, all of a, b, and c, or variations thereof.

Various embodiments and terms used herein are not intended to limit the technical features mentioned herein to particular embodiments, and it is to be appreciated that all changes, equivalents, and/or substitutes that do not depart from the spirit and technical scope are encompassed in the disclosure.

Regarding the description of the drawings, like reference numerals denote similar or related elements.

The singular form of a noun corresponding to an item may include one item or a plurality of items, unless a relevant context clearly dictates otherwise.

The term "and/or" used herein includes any and all combinations of one or more of the associated listed items.

The terms such as "first", "second", "primarily", or "secondary" used herein may represent various elements regardless of order and/or importance, and do not limit corresponding elements. These terms may be used for distinguishing one element from another element.

When an element (e.g., a first element) is mentioned as being "coupled to" or "connected to" another element (e.g., a second element) together with or without the term "operatively" or "communicatively", this may mean that the element may be directly (e.g., by wire) or wirelessly coupled to the other element or another (e.g., a third element) may exist therebetween.

The terms such as "including," "having," and "comprising" used herein are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

When a component is said to be "connected to", "coupled to", "supported by" or "contact" another component, this may include not only a case where the components are directly connected to, coupled to, supported by, or contact each other, but also a case where the components are indirectly connected to, coupled to, supported by, or contact with each other through a third component.

When a component is said to be located "on" another component, this includes not only a case in which a component is in contact with another component, but also a case in which another component exists between two components.

The operational principles of embodiments of the disclosure and various embodiments of the disclosure will now be described more fully with reference to the accompanying drawings.

FIG. 1 is a view for explaining a washing system including a washing machine and a dryer, according to an embodiment of the disclosure.

Referring to FIG. 1, a washing system 100 according to an embodiment of the disclosure may include a washing machine 1000 and a dryer 2000. However, not all of the components illustrated in FIG. 1 are essential. The washing system 100 may be implemented by more or less components than those illustrated in FIG. 1. For example, the washing system 100 may be implemented as the washing machine 1000, the dryer 2000, and a server device (not shown). For example, the washing system 100 may be implemented as the washing machine 1000, the dryer 2000, the server device (not shown), and a mobile terminal (not shown). Each of the components of the washing system 100 will be described.

The washing machine 1000 according to an embodiment of the disclosure, which is a device for automatically washing laundry by using electricity, may perform washing, rinsing, draining, and spin-drying cycles. The washing machine 1000 may perform a drying cycle on the laundry having completed spin-drying. The washing machine 1000 may be an example of a laundry treatment apparatus.

In the disclosure, the washing machine 1000 may include a front surface, a rear surface, an upper surface, a lower surface, and side surfaces. Based on a state in which the washing machine 1000 is generally used or installed, the front surface of the washing machine 1000 is positioned in a direction that a user interface faces, and the rear surface of the washing machine 1000 is positioned in a direction opposite to the front surface. The lower surface of the washing machine 1000 is generally located in a direction toward the floor when the washing machine is installed, and the upper surface of the washing machine 1000 is located in an opposite direction to the lower surface. The washing machine 1000 is divided into an upper portion and a lower portion in a vertical direction, and the upper portion includes the upper surface of the washing machine 1000 and the lower portion includes the lower surface of the washing machine 1000. Such a direction or location is defined for convenience of description, and may be defined differently during actual implementation, manufacturing, installation, or usage.

The washing machine 1000 may include a door 1010 and a control panel 1020. The door 1010 and the control panel 1020 may be located on the front surface of the washing machine 1000. The washing machine 1000 may include an inlet through which laundry is put into a washing chamber, and the inlet may be opened and closed by the door 1010. The control panel 1020 may provide a user interface enabling a user and the washing machine 1000 to interact with each other. For example, the control panel 1020 may receive a user's control input related to the washing machine 1000 and output information related to the washing machine 1000. According to an embodiment of the disclosure, the control panel 1020 may receive a user's control input related to the dryer 2000 and output information related to the dryer 2000.

According to an embodiment of the disclosure, the dryer 2000 is a device capable of drying laundry through high-temperature dry air, and may perform a drying cycle. The dryer 2000 may be an example of a laundry treatment apparatus. In the disclosure, the dryer 2000 may include a front surface, a rear surface, an upper surface, a lower surface, and side surfaces. The front surface of the dryer 2000 may be positioned in a direction which a user interface faces, and a door 2010 may be disposed on the front surface of the dryer 2000. The rear surface of the dryer 2000 is located in an opposite direction to the front surface. The lower surface of the dryer 2000 is generally located in a direction toward the floor when the dryer is installed, and the upper surface of the dryer 2000 is located in an opposite direction to the lower surface. The dryer 2000 is divided into an upper portion and a lower portion in a vertical direction, and the upper portion includes the upper surface of the dryer 2000 and the lower portion includes the lower surface of the dryer 2000.

Figure 16:
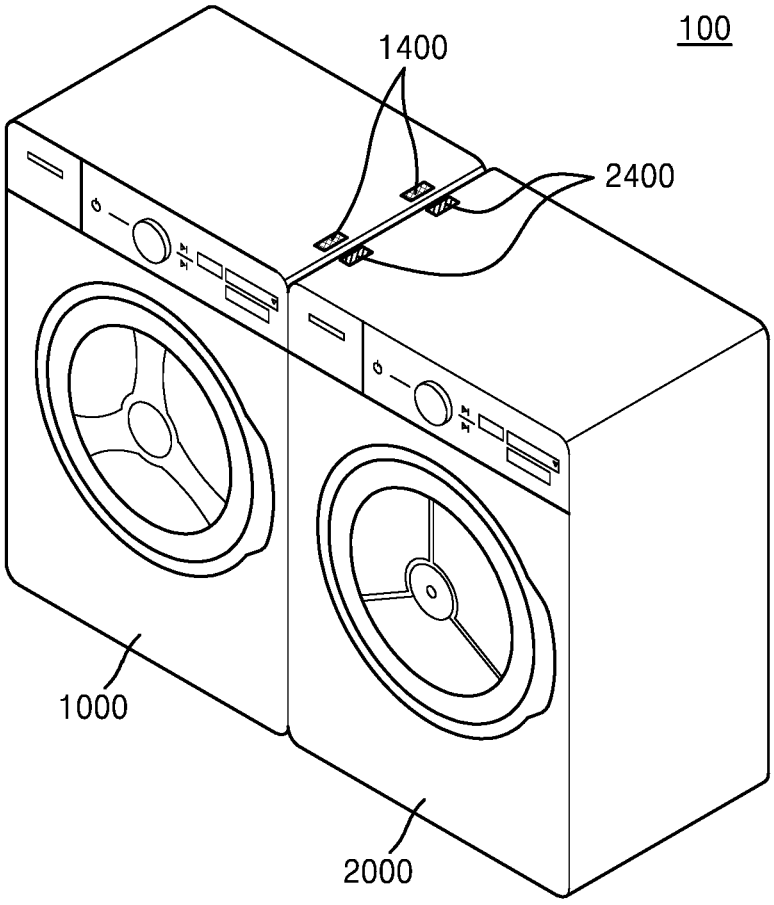
FIG. 16 illustrates a horizontal layout structure of a washing machine and a dryer, according to an embodiment of the disclosure.

In the washing system 100 according to an embodiment of the disclosure, the washing machine 1000 may be disposed adjacent to the dryer 2000. For example, the washing machine 1000 may be arranged adjacent to the dryer 2000 in one direction. The one direction may be a horizontal direction or a vertical direction. For example, as shown in FIG. 1, the washing machine 1000 may be arranged adjacent to the dryer 2000 in the vertical direction. In this case, the washing system 100 may have a vertically stacking structure in which the dryer 2000 is stacked on the washing machine 1000. For example, as shown in FIG. 16, the washing machine 1000 may be arranged adjacent to the dryer 2000 in the horizontal direction. In this case, the washing system 100 may have a parallel structure in which the washing machine 1000 and the dryer 2000 are arranged side by side in the horizontal direction.

The washing machine 1000 according to an embodiment of the disclosure may control the dryer 2000 through wireless communication. For example, the washing machine 1000 may receive the user's control input related to the dryer 2000 through the user interface of the washing machine 1000, and may transmit a control command corresponding to the user's control input to the dryer 2000 through wireless communication.

The washing machine 1000 according to an embodiment of the disclosure may identify an arrangement direction of the washing machine 1000 and the dryer 2000, before performing wireless communication with the dryer 2000. In detail, the washing machine 1000 may identify whether the front surface of the dryer 2000 faces in the same direction as the front surface of the washing machine 1000. When it is determined that the front surface of the dryer 2000 faces in the same direction as the front surface of the washing machine 1000, the washing machine 1000 may control the dryer 2000 through wireless communication (see FIG. 14). On the other hand, when it is determined that the front surface of the dryer 2000 is disposed to face a different direction from the front surface of the washing machine 1000, the washing machine 1000 may restrict an operation of controlling the dryer 2000 through wireless communication (see FIG. 15).

In general, according to the safety standards (e.g., KC, KS, or IEC) of home appliances, it is not possible for a user to operate home appliances out of sight, and thus wireless communication is restricted. The above-described safety standards are intended to prevent a risk that occurs when a home appliance operates in a situation where the internal state of the home appliance cannot be known, for example, when a companion animal or a small child is inside the home appliance.

According to an embodiment of the disclosure, after identifying whether the front surface of the dryer 2000 faces in the same direction as the front surface of the washing machine 1000, the washing machine 1000 may control the dryer 2000 through wireless communication. When the front surface of the dryer 2000 is arranged to face in the same direction as the front surface of the washing machine 1000, the front surface of the dryer 2000 may exist within the user's sight looking at the front surface of the washing machine 1000. Therefore, when the user controls an operation of the dryer 2000 through the control panel 1020 of the washing machine 1000, because the front surface of the dryer 2000 is within the user's sight, the above-described safety standards may be satisfied. The washing machine 1000 according to an embodiment of the disclosure may control the dryer 2000 according to the user's control command input through the user interface, and may receive operation information of the dryer 2000 wirelessly.

Because the washing machine 1000 according to an embodiment of the disclosure may control the dryer 2000 through wireless communication while satisfying the safety standards for wireless communication of the dryer 2000, safety problems may be prevented, and user convenience may be improved. For example, in the case of the laundry system 100 having a vertically stacking structure in which the dryer 2000 is disposed on the washing machine 1000, the user interface of the dryer 2000 may be disposed too high compared to the user's height. According to an embodiment of the disclosure, because the user is able to conveniently operate the dryer 2000 placed over the washing machine 1000 through the user interface of the washing machine 1000 placed below the dryer 2000, user convenience may be improved.

According to an embodiment of the disclosure, the washing machine 1000 may include detection equipment for identifying an arrangement direction of the dryer 2000. The dryer 2000 may include a detection object detected by the detection equipment of the washing machine 1000. For example, referring to FIGS. 3, 6, and 9, the washing machine 1000 according to an embodiment of the disclosure may include a magnetic sensor 1400 as the detection equipment, and the dryer 2000 may include a magnetic body 2400 as the detection object. The washing machine 1000 according to an embodiment of the disclosure may detect a magnetic flux value according to a distance from the magnetic body 2400 through the magnetic sensor 1400 to identify the arrangement direction of the dryer 2000. For example, referring to FIGS. 4 and 10, the washing machine 1000 according to an embodiment of the disclosure may include a second near field communication (NFC) chip 1500 as the detection equipment, and the dryer 2000 may include a first NFC chip 2500 as the detection object. The washing machine 1000 according to an embodiment of the disclosure may identify the arrangement direction of the dryer 2000 by recognizing the first NFC chip 2500 through the second NFC chip 1500.

Figure 11:
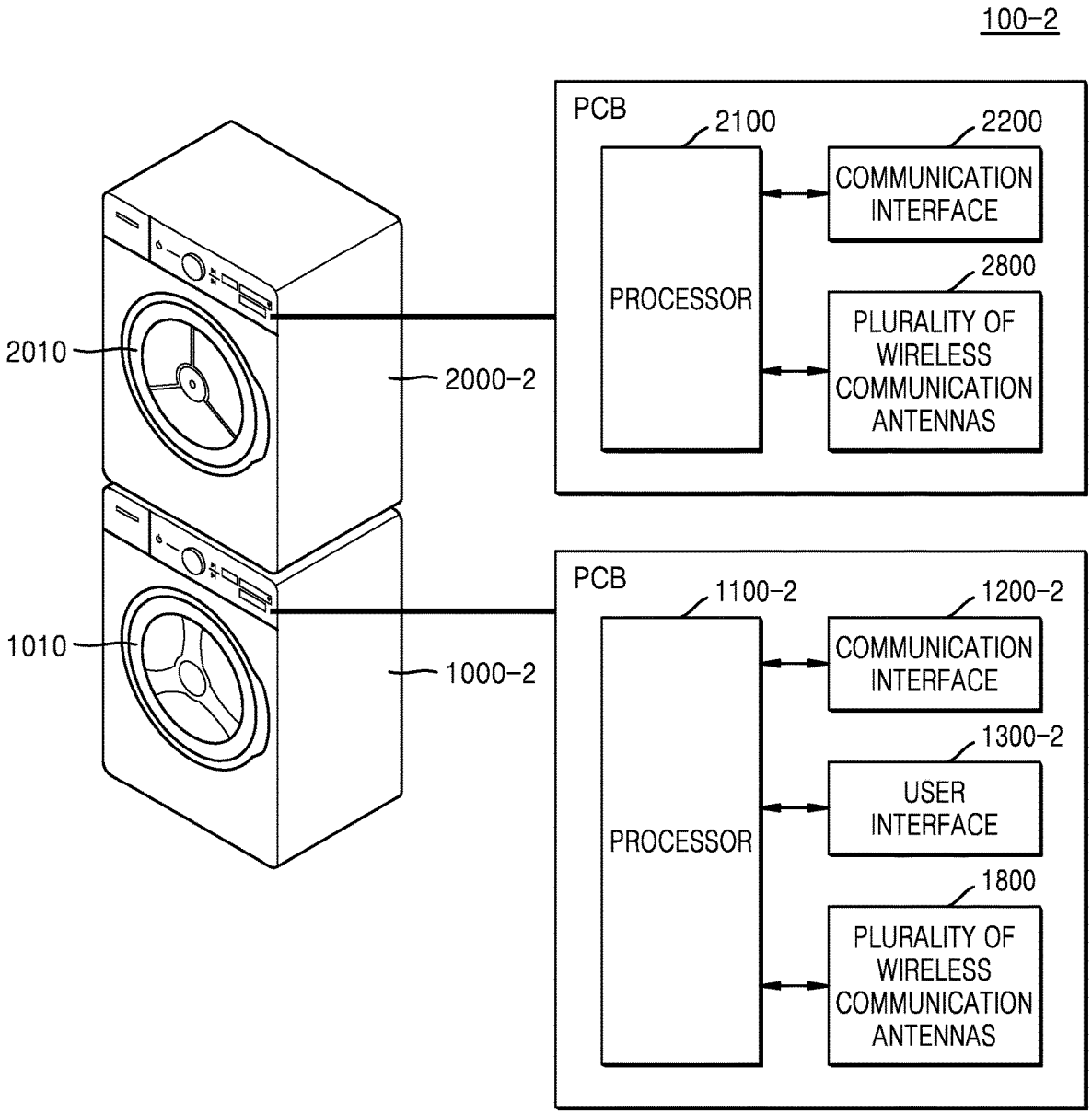
FIG. 11 is a diagram for explaining a structure of a washing machine that identifies an arrangement direction of a dryer by using a plurality of wireless communication antennas, according to an embodiment of the disclosure.
Figure 12A:
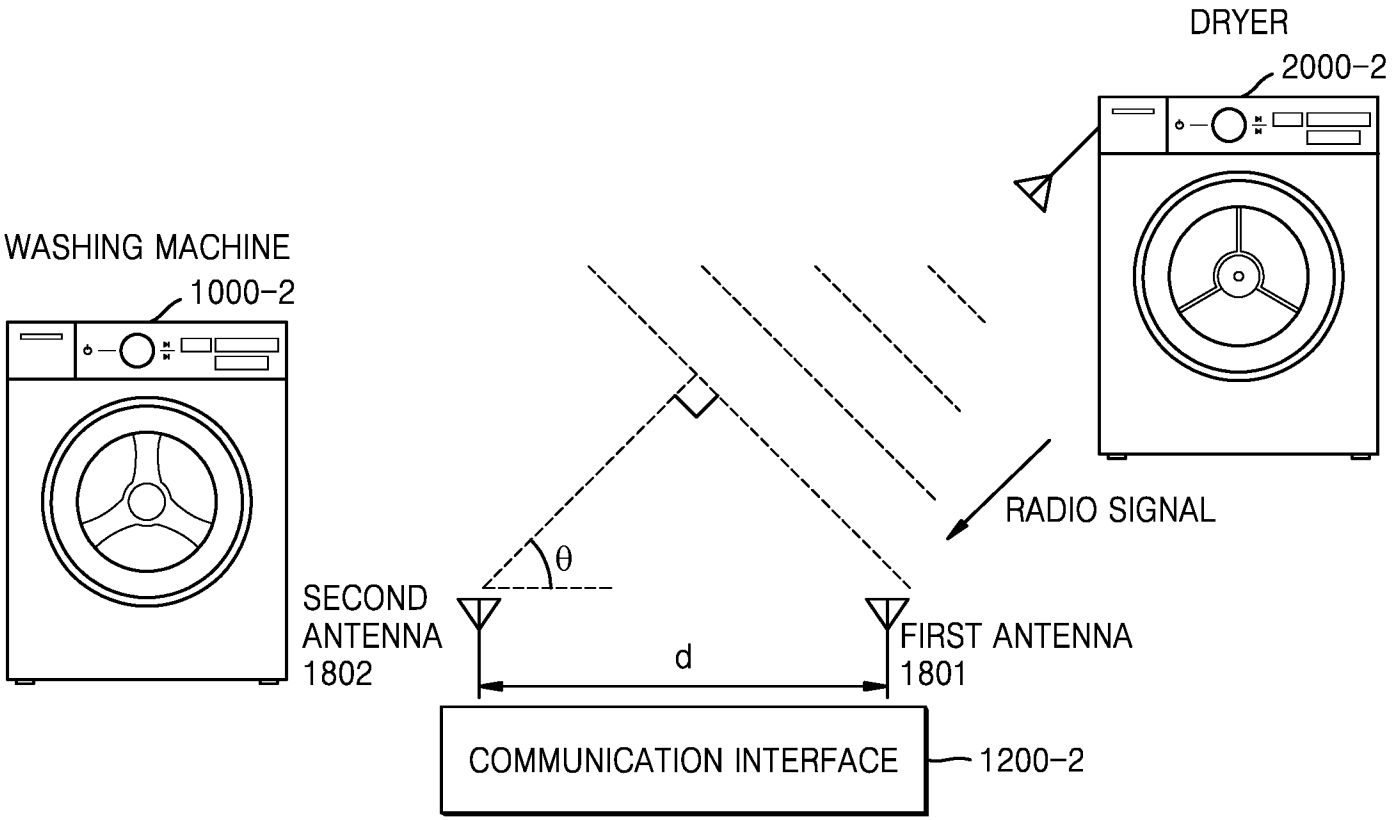
FIGS. 12A and 12B are diagrams for explaining a method, performed by a washing machine, of identifying an arrangement direction of a dryer by using a plurality of wireless communication antennas, according to an embodiment of the disclosure.
Figure 12B:
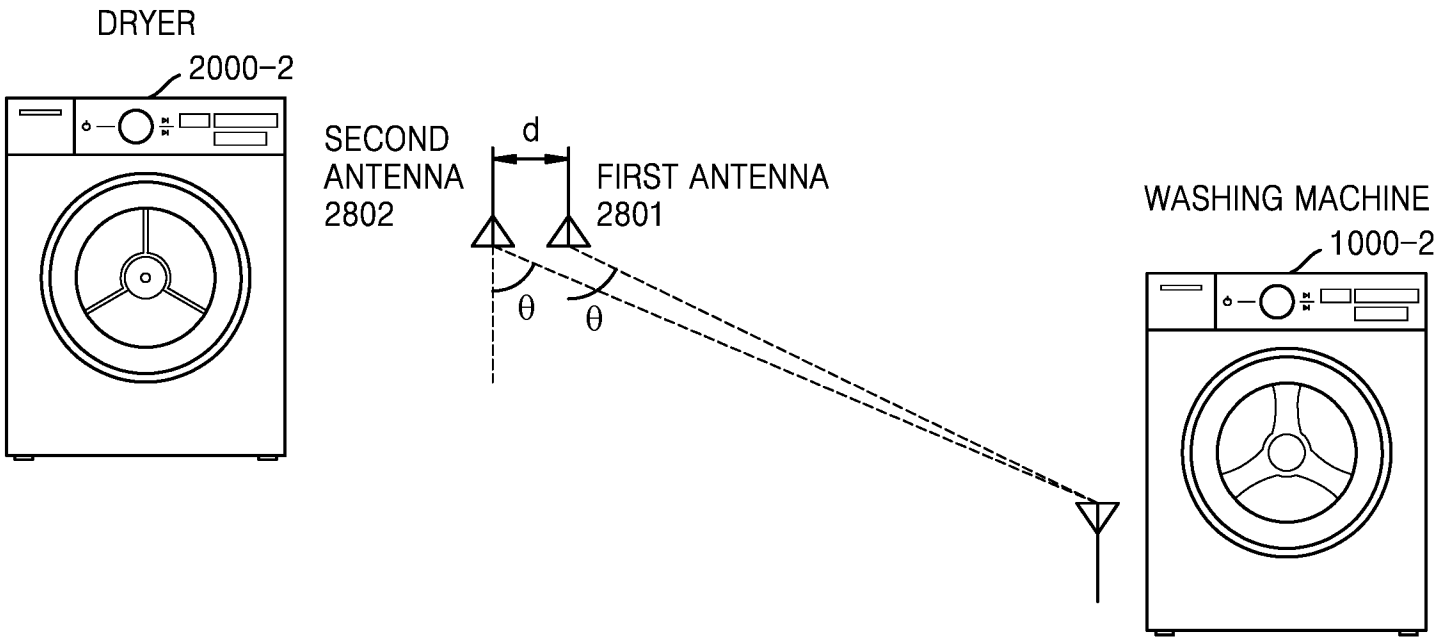
Figure 13:
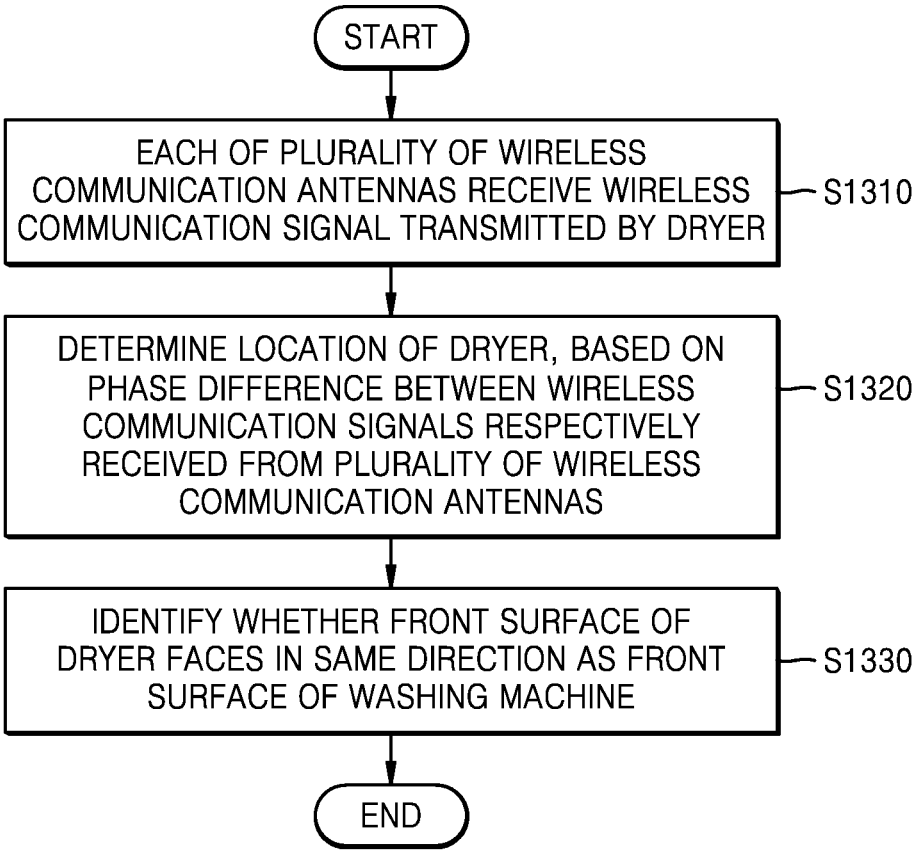
FIG. 13 is a flowchart of a method, performed by a washing machine, of identifying an arrangement direction of a dryer by using a plurality of wireless communication antennas, according to an embodiment of the disclosure.

The washing machine 1000 according to an embodiment of the disclosure may identify the arrangement direction of the dryer 2000 through a plurality of wireless communication antennas. Referring to FIGS. 11 through 13, the washing machine 1000 according to an embodiment of the disclosure may identify the arrangement direction of the dryer 2000, based on a phase difference between wireless communication signals respectively received from a plurality of wireless communication antennas 1800.

However, the washing machine 1000 according to an embodiment of the disclosure is not limited thereto. For example, the dryer 2000 may include detection equipment for identifying the arrangement direction of the washing machine 1000, and the washing machine 1000 may include a detection object detected by the detection equipment of the dryer 2000.

Figure 2:
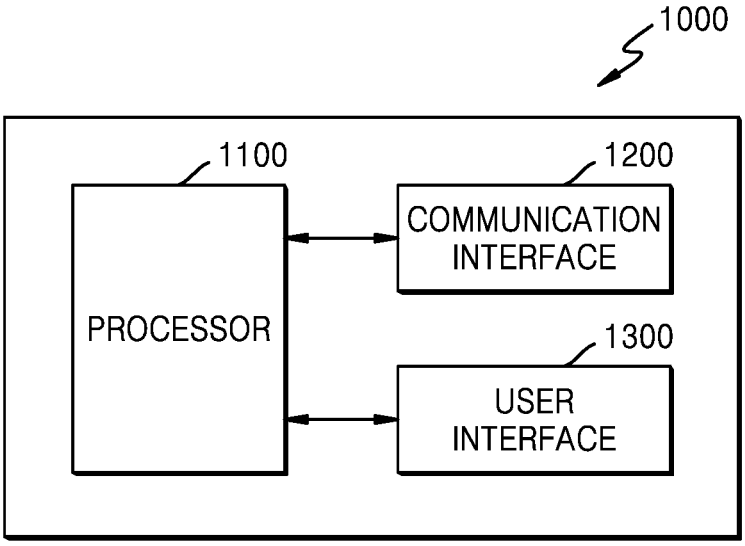
FIG. 2 is a block diagram for explaining a function of a washing machine according to an embodiment of the disclosure.

FIG. 2 is a block diagram for explaining a function of the washing machine 1000 according to an embodiment of the disclosure.

Referring to FIG. 2, the washing machine 1000 according to an embodiment of the disclosure may include a communication interface 1200, a user interface 1300, and a processor 1100. However, all of the components illustrated in FIG. 2 are not essential. The washing machine 1000 may be implemented by more or less components than those illustrated in FIG. 2.

The processor 1100 controls all operations of the washing machine 1000. For example, the processor 1100 may control the communication interface 1200 and the user interface 1300. The processor 1100 may control the communication interface 1200 to transmit or receive a certain signal. The processor 1100 may receive a user input and control the user interface 1300 to output information. The washing machine 1000 may include at least one processor.

The processor 1100 according to an embodiment of the disclosure may control all operations of the dryer 2000. For example, the processor 1100 may identify whether the front surface of the dryer 2000 faces in the same direction as the front surface of the washing machine 1000. When it is determined that the front surface of the dryer 2000 faces in the same direction as the front surface of the washing machine 1000, and the processor 1100 receives a user's control input related to the dryer 2000 through the user interface 1300, the processor 1100 may transmit a control command corresponding to the user's control input related to the dryer 2000 to the dryer 2000 through the communication interface 1200. The user's control input related to the dryer 2000 may include, for example, control activation of the dryer 2000, selection of a drying course, initiation of a drying operation, pause of a drying operation, and drying settings (e.g., a drying degree, wrinkle prevention, and time settings). The drying course may include, for example, standard drying, AI custom drying, quick drying, synthetic fiber drying, wool drying, delicate drying, blanket drying, towel drying, shelf drying, and dusting. The control activation of the dryer 2000 refers to a dryer control mode for obtaining a user input for the dryer 2000.

The communication interface 1200 may include one or more components that enable communication between the washing machine 1000 and the dryer 2000, communication between the washing machine 1000 and a server device (not shown), and communication between the washing machine 1000 and a mobile terminal (not shown). For example, the communication interface 1200 may include a short-range wireless communication interface (e.g., an NFC communication interface, a Bluetooth communication interface, or a BLE communication interface), a long-distance communication interface, etc. According to an embodiment of the disclosure, the communication interface 1200 may wirelessly communicate with the dryer 2000.

The user interface 1300 may receive the user's control input related to the washing machine 1000 or may receive the user's control input related to the dryer 2000. The user interface 1300 may output information related to the washing machine 1000 or may output information related to the dryer 2000. The user's control input related to the washing machine 1000 may include, for example, control activation of the washing machine 1000, selection of a drying course, initiation of a washing operation, pause of a washing operation, and washing settings (e.g., a washing temperature, the number of rinses, and a spin-drying intensity). The washing course may include, for example, standard washing, AI customized washing, heavy washing, wool washing, blanket washing, baby clothes washing, towel washing, boiling washing, ultra-saving washing, outdoor washing, rinsing/spin-drying, and spin-drying. The control activation of the washing machine 1000 refers to a washing machine control mode for obtaining a user input for the washing machine 1000.

According to an embodiment of the disclosure, the dryer 2000 may be controlled through the washing machine 1000 within the sight of the user who manipulates the control panel of the washing machine 1000. For example, the washing machine 1000 may obtain the user's control input related to the washing machine 1000 from the user, or may obtain the user's control input related to the dryer 2000 from the user. The washing machine 1000 may wirelessly transmit, to the dryer 2000, a control command corresponding to the user's control input related to the dryer 2000 obtained from the user. Because the washing machine 1000 may wirelessly control the dryer 2000 according to the safety standards, user convenience may be improved.

Figure 3:
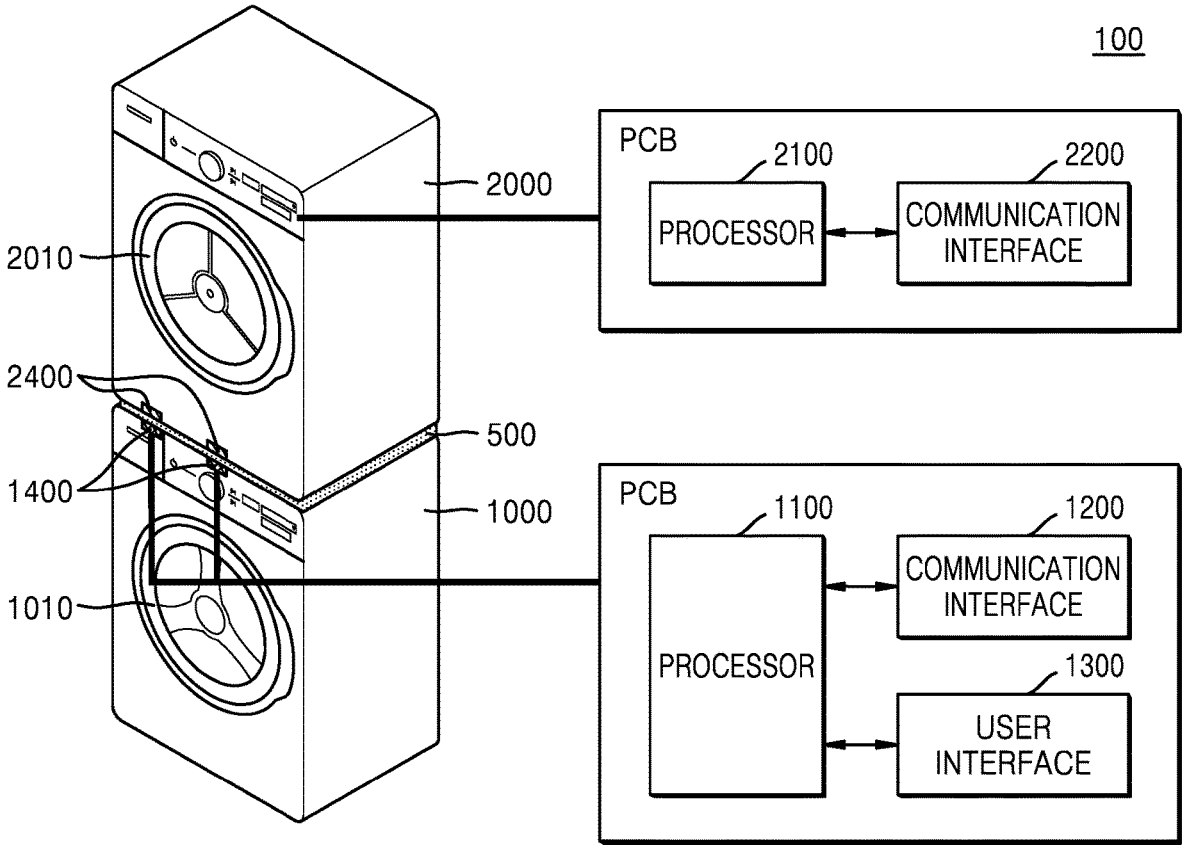
FIG. 3 is a view illustrating a schematic structure of a washing machine including a magnetic sensor, according to an embodiment of the disclosure.

FIG. 3 is a view illustrating a schematic structure of a washing machine including a magnetic sensor, according to an embodiment of the disclosure.

Referring to FIG. 3, the washing machine 1000 in the washing system 100 according to an embodiment of the disclosure may include one or more magnetic sensors 1400 as the detection equipment. The dryer 2000 may include one or more magnetic bodies 2400 as the detection object. The washing machine 1000 may identify the arrangement direction of the dryer 2000 through the one or more magnetic sensors 1400 that detect the one or more magnetic bodies 2400. When it is determined that the dryer 2000 is disposed in the same direction as the washing machine 1000, based on the magnetic flux value measured by the one or more magnetic sensors 1400, the washing machine 1000 may control an operation of the dryer 2000 through wireless communication.

In the washing system 100 according to an embodiment of the disclosure, the washing machine 1000 may be disposed adjacent to the dryer 2000 in one direction. The one or more magnetic sensors 1400 of the washing machine 1400 may be arranged adjacent to the one or more magnetic bodies 2400 of the dryer 2000 in one direction to face the one or more magnetic bodies 2400. For example, the one or more magnetic sensors 1400 may be disposed on one surface of the washing machine 1000 facing the dryer 2000, and the one or more magnetic bodies 2400 may be disposed on one surface of the dryer 2000 facing the washing machine 1000. The one or more magnetic sensors 1400 of the washing machine 1400 may be arranged at locations corresponding to the one or more magnetic bodies 2400 on the one surface of the washing machine 1000. The one direction may be a horizontal direction or a vertical direction. The one surface may be any one of the upper surface, the lower surface, and the side surfaces except for the front and rear surfaces. The washing system 100 having a stacking structure in which the dryer 2000 is stacked on the washing machine 1000 will now be illustrated and described in more detail.

In the washing system 100 according to an embodiment of the disclosure, the washing machine 1000 may be disposed adjacent to the dryer 2000 in the vertical direction. The one or more magnetic sensors 1400 of the washing machine 1000 may be arranged adjacent to the one or more magnetic bodies 2400 of the dryer 2000 in the vertical direction to face the one or more magnetic bodies 2400. For example, the one or more magnetic sensors 1400 may be disposed on an upper end of the washing machine 1000, and the one or more magnetic bodies 2400 may be disposed on a lower end of the dryer 2000. The one or more magnetic sensors 1400 may be arranged at locations corresponding to the one or more magnetic bodies 2400 on the upper end of the washing machine 1000. For example, the one or more magnetic sensors 1400 may be arranged at locations facing the one or more magnetic bodies 2400 on the upper end of the washing machine 1000.

The washing system 100 may further include a support 500 disposed between the washing machine 1000 and the dryer 2000. The support 500 may be a support for dryers that is disposed on the washing machine 1000 and supports the dryer 2000. A distance between the washing machine 1000 and the dryer 2000 separated by the support 500 may be approximately 5 cm, but is not limited thereto.

According to an embodiment of the disclosure, the processor 1100, the communication interface 1200, and the user interface 1300 may be mounted on a printed circuit board (PCB).

The one or more magnetic sensors 1400 may be connected to the PCB through a wire. The one or more magnetic sensors 1400 may measure a magnetic flux value sensed by the one or more magnetic bodies 2400, and may output data to the processor 1100, based on the measured magnetic flux value. For example, the one or more magnetic sensors 1400 may compare the measured magnetic flux value of the one or more magnetic bodies 2400 with a threshold value, and may output data to the processor 1100 when the magnetic flux value is greater than or equal to the threshold value. For example, when the one or more magnetic sensors 1400 are disposed close to the one or more magnetic bodies 2400 (e.g., when the front surface of the washing machine 1000 and the front surface of the dryer 2000 face in the same direction), the one or more magnetic sensors 1400 may measure a magnetic flux value equal to or greater than the threshold value and output '1' to the processor 1100, and, when the one or more magnetic sensors 1400 are farther from the one or more magnetic bodies 2400 (e.g., when the front surface of the washing machine 1000 and the front surface of the dryer 2000 face different directions), the one or more magnetic sensors 1400 may measure a magnetic flux value less than the threshold value and output '0' to the processor 1100.

The processor 1100 may receive data (e.g., 1 or 0) based on the magnetic flux value from the one or more magnetic sensors 1400. The processor 1100 may identify whether the front surface of the dryer 2000 faces in the same direction as the front surface of the washing machine 1000, based on the data received from the one or more magnetic sensors 1400. For example, when 1 is received from the one or more magnetic sensors 1400, the processor 1100 may determine that the front surface of the dryer 2000 faces in the same direction as the front surface of the washing machine 1000, and, when 0 is received from the one or more magnetic sensors 1400, the processor 1100 may determine that the front surface of the dryer 2000 is disposed to face a different direction from the front surface of the washing machine 1000. When it is determined that the front surface of the dryer 2000 faces in the same direction as the front surface of the washing machine 1000, and the processor 1100 receives a user's control input related to the dryer 2000 through the user interface 1300, the processor 1100 may transmit a control command corresponding to the user's control input related to the dryer 2000 to the dryer 2000 through the communication interface 1200.

According to an embodiment of the disclosure, the processor 1100 may receive the magnetic flux value of the one or more magnetic bodies 2400 from the one or more magnetic sensors 1400, and may compare the magnetic flux value with a threshold value. When the magnetic flux value received from the one or more magnetic sensors 1400 is greater than or equal to the threshold value, the processor 1100 may determine that the front surface of the washing machine 1000 and the front surface of the dryer 2000 face in the same direction. When the magnetic flux value received from the one or more magnetic sensors 1400 is less than the threshold value, the processor 1100 may determine that the front surface of the washing machine 1000 and the front surface of the dryer 2000 face different directions.

The dryer 2000 according to an embodiment of the disclosure may include the one or more magnetic bodies 2400, a processor 2100, and a communication interface 2200. The dryer 2000 may wirelessly communicate with the washing machine 1000 through the communication interface 2200. For example, the dryer 2000 may receive the control command corresponding to the user's control input related to the dryer 2000 from the washing machine 1000 through the communication interface 2200. The processor 2100 may perform a drying operation, based on a control command corresponding to a user's control input. The processor 2100 may transmit information about a drying operation to the washing machine 1000 through the communication interface 2200. Accordingly, the washing machine 1000 may receive information about the drying operation through the communication interface 1200, and may output the information about the drying operation through the user interface 1300.

However, an embodiment of the disclosure is not limited thereto, and, when the washing machine 1000 includes a magnetic body as the detection object, the dryer 2000 may include a magnetic sensor as the detection equipment.

In FIG. 3, two magnetic sensors 1400 are disposed on the upper end of the washing machine 1000, and magnetic bodies 2400 are disposed at locations corresponding to the magnetic sensors 1400 on the lower end of the dryer 2000. For example, a magnetic sensor 1400 and a magnetic body 2400 facing each other on the left side of the washing machine 1000 and the dryer 2000 may be disposed as one set, and a magnetic sensor 1400 and a magnetic body 2400 facing each other on the right side of the washing machine 1000 and the dryer 2000 may be disposed as another set. In this case, even when an error occurs in the one set, the other set may operate normally, and thus errors may be minimized in an operation, performed by the washing machine 1000, of identifying the arrangement direction of the dryer 2000. In the disclosure, the number of magnetic sensors 1400 and the number of magnetic bodies 2400 are not limited to the above examples. Each of the number of magnetic sensors 1400 and the number of magnetic bodies 2400 may be one, or may be three or more.

Detailed structures of the magnetic sensor 1400 of the washing machine 1000 and the magnetic body 2400 of the dryer 2000 according to an embodiment of the disclosure will be described later with reference to FIG. 6.

Figure 4:
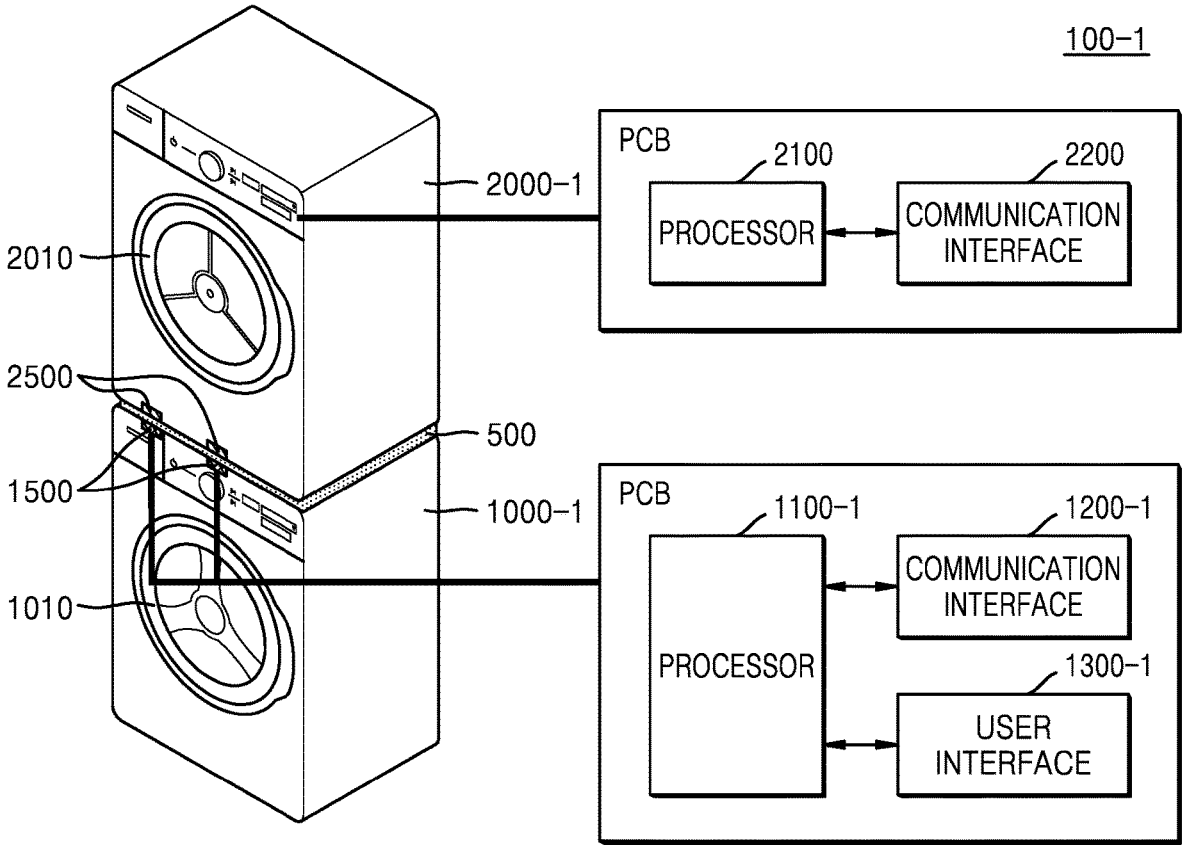
FIG. 4 is a view illustrating a schematic structure of a washing machine including a near field communication (NFC) chip, according to an embodiment of the disclosure.

FIG. 4 is a view illustrating a schematic structure of a washing machine including an NFC chip, according to an embodiment of the disclosure.

Referring to FIG. 4, a washing machine 1000-1 in a washing system 100-1 according to an embodiment of the disclosure may include one or more NFC chips as the detection equipment. A dryer 2000-1 may include one or more NFC chips as the detection object. An NFC chip is a non-contact wireless communication technology capable of exchanging data at a short distance of about 10 cm or less by using a frequency of a 13.56 MHz band. The NFC chip may include an NFC module, an NFC tag, and an NFC reader. The NFC module, which is a bi-directional communication module, may transmit/receive information to/from other NFC modules. The NFC tag may store data capable of recognizing certain information, and the NFC reader may recognize data stored in the NFC tag through electromagnetic induction. According to an embodiment of the disclosure, the NFC chip of the washing machine 1000-1 is referred to as the second NFC chip 1500, and may include an NFC reader or an NFC module. The NFC chip of the dryer 2000-1 is referred to as the first NFC chip 2500, and may include an NFC tag or an NFC module.

In the washing system 100-1 according to an embodiment of the disclosure, the washing machine 1000-1 may be disposed adjacent to the dryer 2000-1 in the vertical direction. The second NFC chip 1500 of the washing machine 1000-1 may be arranged adjacent to the first NFC chip 2500 of the dryer 2000-1 in the vertical direction to face the first NFC chip 2500. For example, the second NFC chip 1500 may be disposed on an upper end of the washing machine 1000-1, and the first NFC chip 2500 may be disposed on a lower end of the dryer 2000-1. The second NFC chip 1500 may be disposed at a location corresponding to the first NFC chip 2500 on the upper end of the washing machine 1000-1. For example, the second NFC chip 1500 may be disposed at a location facing the first NFC chip 2500 on the upper end of the washing machine 1000-1.

The first NFC chip 2500 and the second NFC chip 1500 may be spaced apart from each other by a certain distance with the support 500 interposed therebetween. The distance between the first NFC chip 2500 and the second NFC chip 1500 may be within 10 cm, more precisely, within 5 cm, but is not limited thereto. Because an NFC chip performs short-range wireless communication, the second NFC chip 1500 may be easily recognized by the first NFC chip 2500 as the second NFC chip 1500 is closer to the first NFC chip 2500. In other words, as the upper end of the washing machine 1000-1 and the lower end of the dryer 2000-1 are closer to each other, the washing machine 1000-1 may easily determine whether the dryer 2000-1 disposed on the washing machine 1000-1 faces in the same direction as the washing machine 1000-1.

The second NFC chip 1500 may be connected to a PCB through a wire. The second NFC chip 1500 may recognize the first NFC chip 2500 facing the second NFC chip 1500. When the processor 1100-1 receives information about the first NFC chip 2500 through the second NFC chip 1500, the processor 1100-1 may determine that the front surface of the dryer 2000-1 faces in the same direction as the front surface of the washing machine 1000-1. When the processor 1100-1 does not receive the information about the first NFC chip 2500 through the second NFC chip 1500, the processor 1100-1 may determine that the front surface of the dryer 2000-1 is disposed to face a different direction from the front surface of the washing machine 1000-1.

The washing machine 1000-1 according to an embodiment of the disclosure may identify an arrangement direction of the dryer 2000-1 by recognizing the first NFC chip 2500 through the second NFC chip 1500. When it is determined that the dryer 2000-1 is disposed in the same direction as the washing machine 1000-1, the washing machine 1000-1 may control an operation of the dryer 2000-1 through wireless communication. When it is determined that the front surface of the dryer 2000-1 faces in the same direction as the front surface of the washing machine 1000-1, and the processor 1100-1 receives a user's control input related to the dryer 2000-1 through a user interface 1300-1, the processor 1100-1 may transmit a control command corresponding to the user's control input related to the dryer 2000-1 to the dryer 2000-1 through a communication interface 1200-1.

However, an embodiment of the disclosure is not limited thereto, and, when the washing machine 1000 includes a first NFC chip as the detection object, the dryer 2000 may include a second NFC chip as the detection equipment.

In FIG. 4, two second NFC chips 1500 are disposed on the upper end of the washing machine 1000-1, and first NFC chips 2500 are disposed at locations corresponding to the second NFC chips 1500 on the lower end of the dryer 2000-1. However, in the disclosure, the number of first NFC chips 2500 and the number of second NFC chips 1500 are not limited thereto.

Because an NFC chip includes a coil for forming an induced current, it may be advantageous to be located in an environment where a non-metallic material exists to form an induced current. Therefore, according to an embodiment of the disclosure, the NFC chip may be formed not to contact metal. For example, the second NFC chip 1500 may be disposed at a location having a non-metallic material on the upper end of the washing machine 1000-1, and may be formed not to contact metal. The first NFC chip 2500 may be disposed at a location having a non-metallic material on the lower end of the dryer 2000-1.

The washing machine 1000-1 of FIG. 4 may correspond to the washing machine 1000 of FIG. 2, and the washing machine 1000-1 of FIG. 4 may further include the first NFC chip 1500 compared to the washing machine 1000 of FIG. 2.

Figure 5:
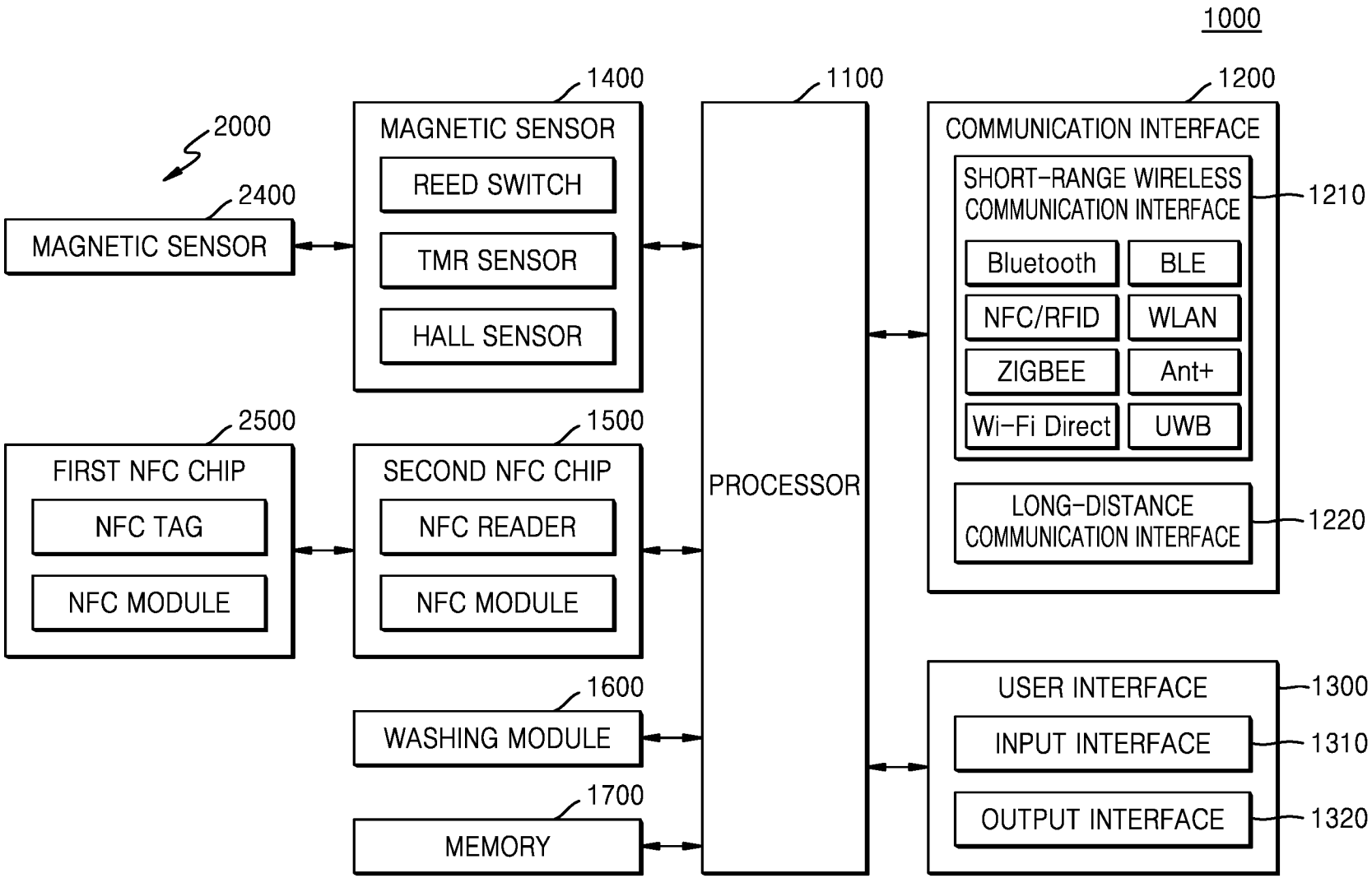
FIG. 5 is a detailed block diagram for explaining a function of a washing machine according to an embodiment of the disclosure.

FIG. 5 is a detailed block diagram for explaining a function of the washing machine 1000 according to an embodiment of the disclosure.

Referring to FIG. 5, the washing machine 1000 according to an embodiment of the disclosure may include a processor 1100, a communication interface 1200, a user interface 1300, a magnetic sensor 1400, a second NFC chip 1500, a washing module 1600, and a memory 1700. Although FIG. 5 illustrates a case where the washing machine 1000 includes both the magnetic sensor 1400 and the second NFC chip 1500, the disclosure is not limited thereto, and the washing machine 1000 may include only one of the magnetic sensor 1400 and the second NFC chip 1500. A description of FIG. 5 that is the same as given above with reference to FIG. 2 will not be repeated herein.

The washing machine 1000 may include a top-loading washing machine in which an inlet for putting in or taking out laundry is provided to face upwards, or a front-loading washing machine in which an inlet for putting in or taking out laundry is provided in a forward direction. The washing machine 1000 may include a washing machine 1000 of a loading type other than the top loading washing machine and the front loading washing machine.

The processor 1100 controls an overall operation of the washing machine 1000. The processor 1100 may control the communication interface 1200, the user interface 1300, the magnetic sensor 1400, the second NFC chip 1500, the washing module 1600, and the memory 1700 by executing programs stored in the memory 1700. The processor 1100 may include a separate neural processing unit (NPU) for performing an operation of an AI model. The processor 1100 may also include a central processing unit (CPU), a graphics processing unit (GPU), etc. In the disclosure, the processor 1100 may include one or more processors. For example, the processor 1100 may include a first processor that controls the washing module 1600, and a second processor that controls the user interface 1300 and the communication interface 1200. In this case, the first processor and the second processor of the processor 1100 may perform universal asynchronous receiver/transmitter (UART) communication, but the disclosure is not limited thereto.

According to an embodiment of the disclosure, the processor 1100 may identify whether the front surface of the dryer 2000 faces in the same direction as the front surface of the washing machine 1000. When it is determined that the front surface of the dryer 2000 faces in the same direction as the front surface of the washing machine 1000, and the processor 1100 receives a user's control input related to the dryer 2000 through the user interface 1300, the processor 1100 may transmit a control command corresponding to the user's control input related to the dryer 2000 to the dryer 2000 through the communication interface 1200.

According to an embodiment of the disclosure, when the washing machine 1000 includes the magnetic sensor 1400 and the dryer 2000 includes a magnetic body 2400, the processor 1100 may identify whether the front surface of the dryer 2000 faces in the same direction as the front surface of the washing machine 1000, based on the magnetic flux value sensed by the magnetic sensor 1400. For example, when it is determined that the magnetic flux value sensed by the magnetic sensor 1400 is equal to or greater than the threshold value, the processor 1100 may determine that the front surface of the dryer 2000 faces in the same direction as the front surface of the washing machine 1000, and, when it is determined that the magnetic flux value sensed by the magnetic sensor 1400 is less than the threshold value, the processor 1100 may determine that the front surface of the dryer 2000 is disposed to face a different direction from the front surface of the washing machine 1000.

According to an embodiment of the disclosure, when the washing machine 1000 includes the second NFC chip 1500 and the dryer 2000 includes a first NFC chip 2500, the processor 1100 may identify whether the front surface of the dryer 2000 faces in the same direction as the front surface of the washing machine 1000, by recognizing the first NFC chip 2500 arranged on the lower end of the dryer 2000 by using the second NFC chip 1500.

According to an embodiment of the disclosure, the processor 1100 may perform an operation course of the washing machine 1000 in response to the user's control input related to the washing machine 1000 received through the user interface 1300. When it is determined that the front surface of the dryer 2000 faces in the same direction as the front surface of the washing machine 1000, the processor 1100 may transmit a control command for the dryer 2000 to prepare for drying to the dryer 2000 through the communication interface 1200, based on the operation course of the washing machine 1000. The processor 1100 may output information about the drying preparation of the dryer 2000 performed according to the control command through the user interface 1300.

According to an embodiment of the disclosure, when it is determined that the front surface of the dryer 2000 is disposed to face a different direction from the front surface of the washing machine 1000, the processor 1100 may perform at least one of an operation of outputting a message for checking the direction of the dryer 2000 through the user interface 1300 or an operation of ignoring a user's control input related to the dryer 2000 received through the user interface 1300.

According to an embodiment of the disclosure, the processor 1100 may receive operation information of the dryer 2000 through the communication interface 1200, and may output the operation information of the dryer 2000 through the user interface 1300.

The communication interface 1200 may include at least one of a short-range wireless communication interface 1210 or a long-distance communication interface 1220. The communication interface 1200 may include at least one antenna for communicating with other devices wirelessly. The short-range wireless communication interface 1210 may include, but is not limited to, a Bluetooth communication interface, a Bluetooth Low Energy (BLE) communication interface, a Near Field Communication (NFC) interface, a WLAN (Wi-Fi) communication interface, a Zigbee communication interface, an infrared Data Association (IrDA) communication interface, a Wi-Fi Direct (WFD) communication interface, a ultrawideband (UWB) communication interface, an Ant+ communication interface, and a micro-wave (uWave) communication interface. The long-distance communication interface 1220 may include communication modules for performing various types of long-distance communication.

According to an embodiment of the disclosure, the communication interface 1200 may transmit, to the dryer 2000, a control command corresponding to the user's control input related to the dryer 2000, in response to the user's control input related to the dryer 2000 (e.g., control activation, drying course selection, drying operation initiation, drying operation pause, and drying settings). The communication interface 1200 may receive operation information of the dryer 2000 (e.g., drying course information and operation time information) from the dryer 2000.

The user interface 1300 may include an input interface 1310 and an output interface 1320. The input interface 1310 may receive an input from a user and transmit the input to the processor 1100. The input interface 1310 may include buttons related to the washing machine 1000, for example, a power button, a washing machine control activation button, a washing machine operation button, a course selection dial (or a course selection button), or a wash/rinse/spin-dry setting button. The input interface 1310 may also include buttons related to the dryer 2000. For example, the input interface 1310 may include a dryer control activation button, a dryer operation button, a course selection dial (or a course selection button), or a drying degree/wrinkle prevention/time setting button. The input interface 1310 may include, for example, a tact switch, a push switch, a slide switch, a toggle switch, a micro switch, or a touch switch.

The output interface 1320 may output various pieces of information related to the operation of the washing machine 1000. The output interface 1320 includes, for example, a display, a light emitting diode (LED), or a speaker. For example, the output interface 1320 may output washing course information, drying course information, operation time information, and the like through the display.

The magnetic sensor 1400 may be a sensor that detects that the dryer 2000 is disposed on the washing machine 1000. The magnetic sensor 1400 may measure a magnetic flux value sensed by the magnetic body 2400 of the dryer 2000, and may output data to the processor 1100, based on the measured magnetic flux value. For example, the magnetic sensor 1400 may compare the measured magnetic flux value of the magnetic body 2400 with a threshold value, and may output data to the processor 1100 when the magnetic flux value is greater than or equal to the threshold value and may not output data to the processor 1100 when the magnetic flux value is less than the threshold value. For example, when the magnetic sensor 1400 is disposed close to the magnetic body 2400, the magnetic sensor 1400 may measure a magnetic flux value equal to or greater than the threshold value (e.g., 5V output when using a magnetic sensor), and, when the magnetic sensor 1400 is farther away from the magnetic body 2400, the magnetic sensor 1400 may measure a magnetic flux value less than the threshold value (e.g., 0V output when using a magnetic sensor). For example, the magnetic sensor 1400 may output the measured magnetic flux value to the processor 1100, and the processor 1100 may compare the magnetic flux value received from the magnetic sensor 1400 with the threshold value to thereby determine the arrangement direction of the dryer 2000 and the washing machine 1000.

The magnetic sensor 1400 is a sensor for measuring the magnitude or direction of a magnetic field, and may include a reed switch, a tunnel magnetoresistance (TMR) sensor, a Hall sensor, etc. The reed switch is a mechanical switch activated by a magnetic field, and may be turned on when the magnetic body 2400 approaches, and turned off when the magnetic body 2400 moves away. The TMR sensor has higher magnetic flux sensitivity than a Hall sensor and lower sensitivity to vibration than a reed switch, so that the reliability of sensitivity may be secured. The Hall sensor is a sensor that measures a magnetic flux density using a Hall effect, and may output a voltage proportional to the magnetic flux density.

The second NFC chip 1500 may include one of an NFC reader and an NFC module. The first NFC chip 2500 of the dryer 2000 corresponding to the second NFC chip 1500 may include one of an NFC tag and an NFC module. The processor 1100 may recognize the first NFC chip 2500 through the second NFC chip 1500, and may identify whether the dryer 2000 is disposed in the same direction as the washing machine 1000.

For example, the second NFC chip 1500 may include an NFC reader, and the first NFC chip 2500 may include an NFC tag. In this case, the NFC reader of the washing machine 1000 may recognize data stored in the NFC tag of the dryer 2000, and may identify whether the dryer 2000 is disposed in the same direction as the washing machine 1000.

For example, the second NFC chip 1500 may include an NFC module, and the first NFC chip 2500 may include an NFC module. The NFC module of the washing machine 1000 may recognize data about the dryer 2000 received from the NFC module of the dryer 2000, and may identify whether the dryer 2000 is disposed in the same direction as the washing machine 1000.

According to an embodiment of the disclosure, the first NFC chip 2500 may store security information that may be distinguished from a general NFC card. The second NFC chip 1500 may verify the security information of the first NFC chip 2500. For example, security information related to the dryer 2000 may be stored in the NFC tag, and the NFC reader may verify the security information of the NFC tag. For example, the security information related to the dryer 2000 may be stored in the NFC module of the dryer 2000, and the NFC module of the washing machine 1000 may verify the security information of the NFC module of the dryer 2000.

The washing module 1600 may include, for example, a driving module configured to drive a washing chamber, a water supply module for supplying water to the washing chamber, a detergent supply module for supplying detergent to the washing chamber, a drainage module for discharging water contained in the washing chamber to the outside, and a power module for supplying power to the components of the washing machine 1000.

The memory 1700 stores or records various pieces of information, data, instructions, programs, etc., necessary for operations of the washing machine 1000. The memory 1700 may store temporary data (e.g., a washing course, washing settings, a drying course, and drying settings) generated while generating control signals for controlling the components included in the washing machine 1000. The memory 1700 may include one or both of volatile memory and nonvolatile memory, or a combination thereof.

The memory 1700 may include at least one type of storage medium selected from among a flash memory type, a hard disk type, a multimedia card micro type, a card type memory (for example, a secure digital (SD) or extreme digital (XD) memory), a random access memory (RAM), a static random access memory (SRAM), a read-only memory (ROM), an electrically erasable programmable ROM (EEPROM), a programmable ROM (PROM), magnetic memory, a magnetic disk, and an optical disk. The programs stored in the memory 1700 may be classified into a plurality of modules according to their functions.

Figure 6:
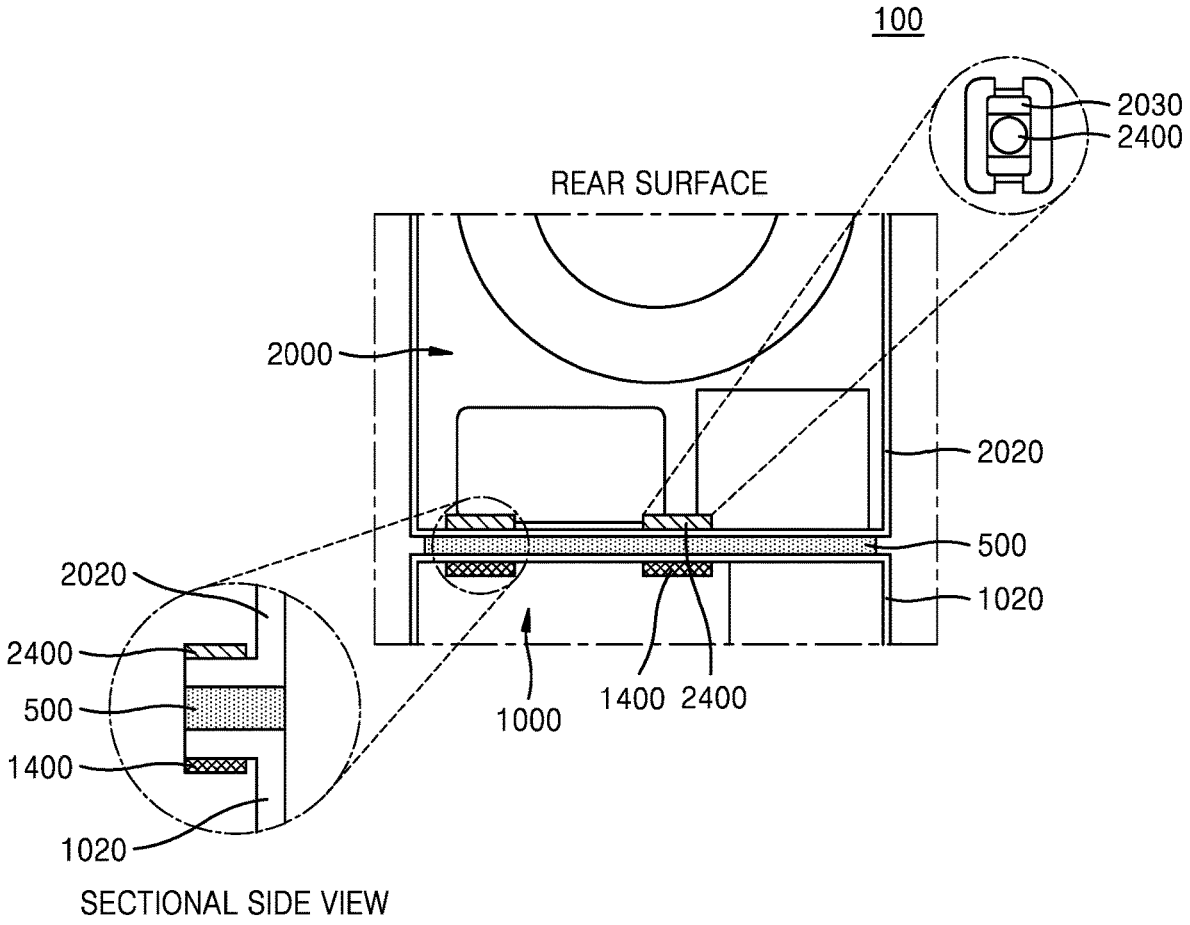
FIG. 6 is a view for explaining detailed structures of a washing machine including a magnetic sensor and a dryer including a magnetic body, according to an embodiment of the disclosure.

FIG. 6 is a view for explaining detailed structures of a washing machine including a magnetic sensor and a dryer including a magnetic body, according to an embodiment of the disclosure.

FIG. 6 illustrates the rear surface of the control panel 1020 located on the upper end of the washing machine 1000 and a portion of a lower portion of the rear surface of a front frame 2020 of the dryer 2000.

The magnetic sensor 1400 may be disposed on the upper end of the control panel 1020 of the washing machine 1000, and the magnetic body 2400 may be disposed on the lower end of the front frame 2020 of the dryer 2000 spaced apart from the magnetic sensor 1400 through the support 500.

The magnetic sensor 1400 may be located in an environment where a non-metallic material exists in order to secure a magnetic flux density. The magnetic sensor 1400 may have a shorter sensing distance with respect to the magnetic body 2400 and a reduced magnetic flux density due to metal. According to an embodiment of the disclosure, the magnetic sensor 1400 may be arranged on the control panel 1020 having a plastic material on the upper end of the washing machine 1000.

The magnetic body 2400 may be located in an environment where a non-metallic material exists in order to secure a magnetic flux density. For example, the magnetic body 2400 may be arranged on the front frame 2020 having a plastic material on the lower end of the dryer 2000. The magnetic body 2400 may be mounted in a housing 2030 made of a non-metallic material, for example, a plastic material.

Because the washing machine 1000 according to an embodiment of the disclosure satisfies the safety standards and is capable of wireless communication with the dryer 2000, a wired communication interface, for example, a connection line, for connecting the washing machine 1000 to the dryer 2000 may be omitted. Accordingly, installation of the washing system 100 including the washing machine 1000 and the dryer 2000 may be simplified, and the rate of occurrence of quality defects due to defective connection lines may be reduced.

Figure 7:
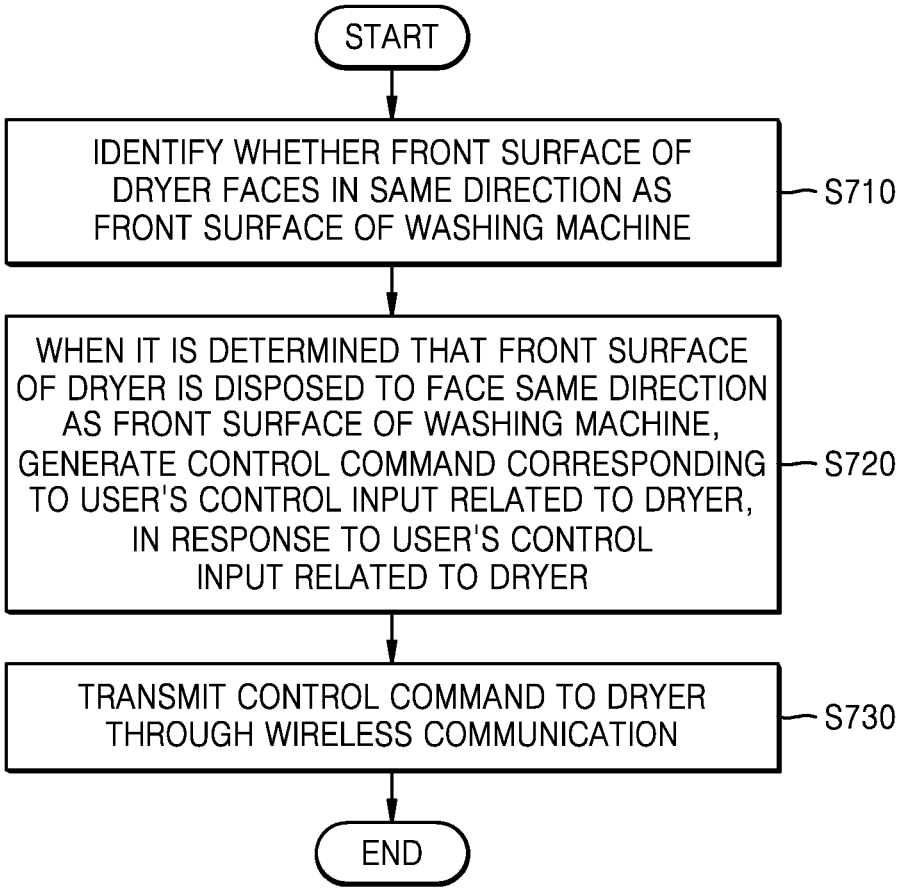
FIG. 7 is a flowchart of an operation, performed by a washing machine, of controlling a dryer, according to an embodiment of the disclosure.

FIG. 7 is a flowchart of an operation, performed by a washing machine, of controlling a dryer, according to an embodiment of the disclosure.

Referring to FIG. 7, in operation S710, the processor 1100 may identify whether the front surface of the dryer 2000 faces in the same direction as the front surface of the washing machine 1000. For example, when the washing machine 1000 includes the detection equipment and the dryer 2000 includes the detection object detected by the detection equipment, the processor 1100 may identify whether the front surface of the dryer 2000 faces in the same direction as the front surface of the washing machine 1000. For example, the detection equipment may be the magnetic sensor 1400 or the second NFC chip 1500, and the detection object may be the magnetic body 2400 or the first NFC chip 2500, but the disclosure is not limited thereto. For example, when the washing machine 1000 includes a plurality of wireless communication antennas, the processor 1100 may identify whether the front surface of the dryer 2000 faces in the same direction as the front surface of the washing machine 1000.

In operation S720, when it is determined that the front surface of the dryer 2000 faces in the same direction as the front surface of the washing machine 1000, the processor 1100 may receive a user's control input related to the dryer 2000 and may generate a control command corresponding to the user's control input related to the dryer 2000. For example, the processor 1100 may recognize the detection object of the dryer 2000 through the detection equipment, and may determine that the front surface of the dryer 2000 faces in the same direction as the front surface of the washing machine 1000, based on detection of the detection object. The processor 1100 may receive a user's control input regarding a drying operation through the user interface 1300, and may generate a control command.

In operation S730, the processor 1100 may transmit the control command to the dryer 2000 through wireless communication. For example, the processor 1100 may transmit the control command to the dryer 2000 through a BLE communication module, a UWB communication module, etc.

According to an embodiment of the disclosure, the dryer 2000 may be controlled through the washing machine 1000 within the sight of the user who manipulates the control panel of the washing machine 1000. Because the washing machine 1000 may wirelessly control the dryer 2000 according to the safety standards, user convenience may be improved.

Figure 8:
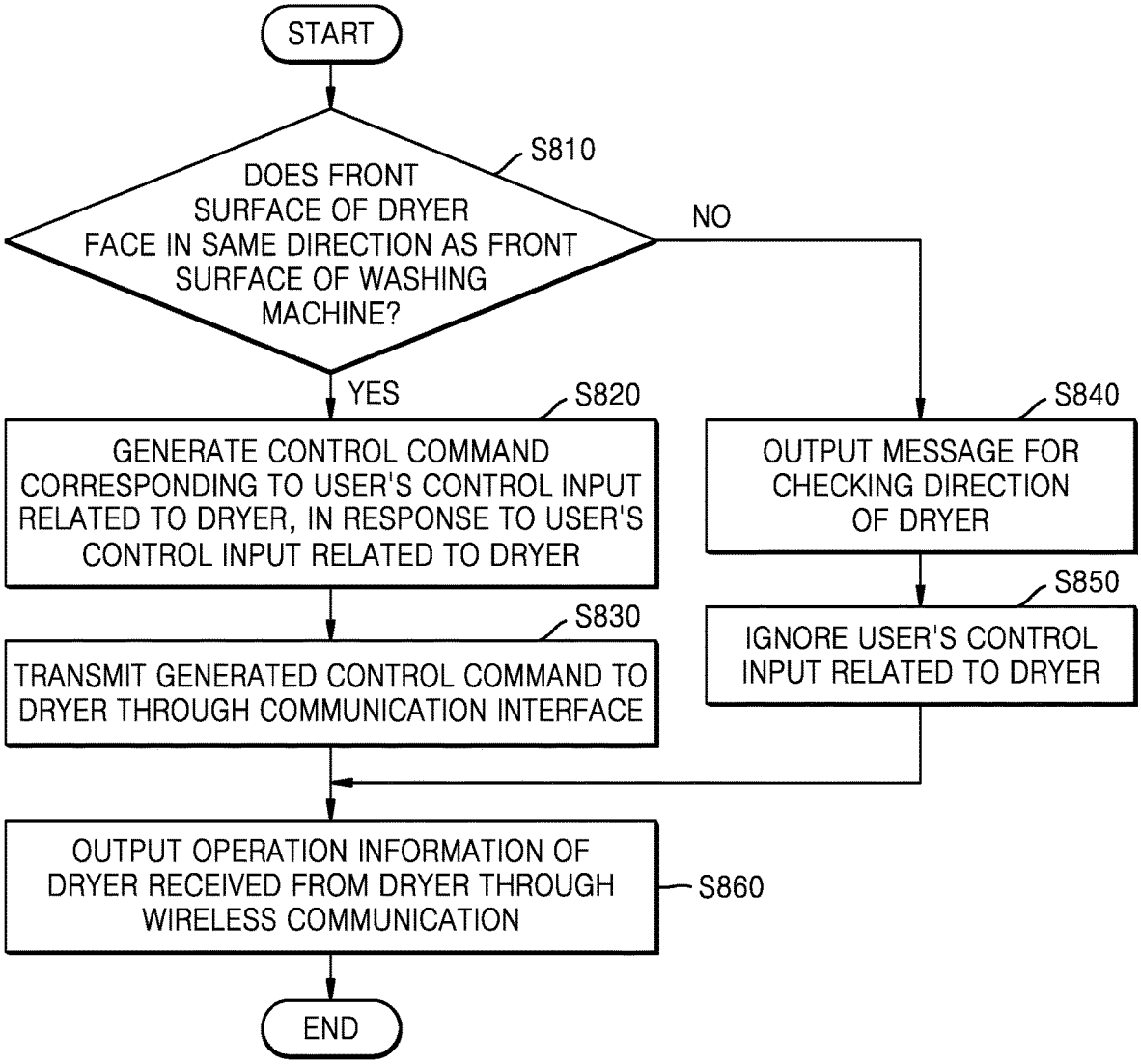
FIG. 8 is a flowchart of an operation of a washing machine according to an arrangement direction of a washing machine and a dryer, according to an embodiment of the disclosure.

FIG. 8 is a flowchart of an operation of a washing machine according to an arrangement direction of a washing machine and a dryer, according to an embodiment of the disclosure.

Referring to FIG. 8, in operation S810, the processor 1100 may identify whether the front surface of the dryer 2000 faces in the same direction as the front surface of the washing machine 1000. For example, in FIG. 9, the washing machine 1000 according to an embodiment of the disclosure may identify the arrangement direction of the dryer 2000 through the magnetic sensor 1400. For example, in FIG. 10, the washing machine 1000 according to an embodiment of the disclosure may identify the arrangement direction of the dryer 2000 through an NFC chip.

In operation S820, when it is determined that the front surface of the dryer 2000 faces in the same direction as the front surface of the washing machine 1000, the processor 1100 may receive a user's control input related to the dryer 2000 and may generate a control command corresponding to the user's control input related to the dryer 2000.

For example, when it is determined that the front surface of the dryer 2000 faces in the same direction as the front surface of the washing machine 1000, the processor 1100 may activate the user interface 1300 related to the dryer 2000. For example, the processor 1100 may receive a user's control input regarding a dryer control activation button, a dryer operation button, a course selection dial (or a course selection button), or a drying degree/wrinkle prevention/time setting button, for example, and may generate a control command.

In operation S830, the processor 1100 may transmit the generated control command to the dryer 2000 through the communication interface 1200. For example, the processor 1100 may transmit, to the dryer 2000 through wireless communication (e.g., BLE communication), a control command regarding a drying operation, for example, control activation of the dryer 2000, drying operation initiation, drying operation pause, and drying settings (e.g., a drying degree, wrinkle prevention, and time settings).

In operation S840, when it is determined that the front surface of the dryer 2000 is disposed to face a different direction from the front surface of the washing machine 1000, the processor 1100 may output a message for checking a direction of the dryer 2000. For example, the processor 1100 may output a message "Check the arrangement direction of the dryer" on the user interface 1300. The processor 1100 may output, to the user through a display or a speaker, a message indicating that the disposition direction of the dryer 2000 is different from that of the washing machine 1000.

The processor 1100 according to an embodiment of the disclosure may output a notification message through a mobile device (not shown). The mobile device may be a terminal registered to a server device (not shown) with the same account as the washing machine 1000. For example, the processor 1100 may transmit the notification message to the mobile device through wireless communication (e.g., BLE communication). The user may relocate the front surface of the dryer 2000 to face in the same direction as the front surface of the washing machine 1000 through the notification message output to the mobile device.

In operation S850, when it is determined that the front surface of the dryer 2000 is disposed to face a different direction from the front surface of the washing machine 1000, the processor 1100 may ignore the user's control input related to the dryer 2000. When it is determined that the front surface of the dryer 2000 is disposed to face a different direction from the front surface of the washing machine 1000, the processor 1100 may deactivate the user interface 1300 related to the dryer 2000. For example, the processor 1100 may ignore a user's control input regarding a dryer control activation button, a dryer operation button, a course selection dial (or a course selection button), or a drying degree/wrinkle prevention/time setting button, for example, and may not generate a signal according to a touch input.

In operation S860, the processor 1100 may output operation information of the dryer 2000 received from the dryer 2000 through wireless communication. For example, while the dryer 2000 is being operated, the processor 1100 may output operation information of the dryer 2000 (e.g., drying course information or operation time information). The user interface 1100 may output operation information of the dryer 2000 operating through the control command of the washing machine 1000. The processor 1100 may output operation information of the dryer 2000 that operates based on a control command input received from the user through a user interface of the dryer 2000. In other words, even when the washing machine 1000 does not provide a control command to the dryer 2000, the washing machine 1000 may output the operation information of the dryer 2000.

A method, performed by the washing machine 1000 according to an embodiment of the disclosure, of identifying the disposition direction of the dryer 2000 will now be described with reference to FIGS. 9 and 10.

Figure 9:
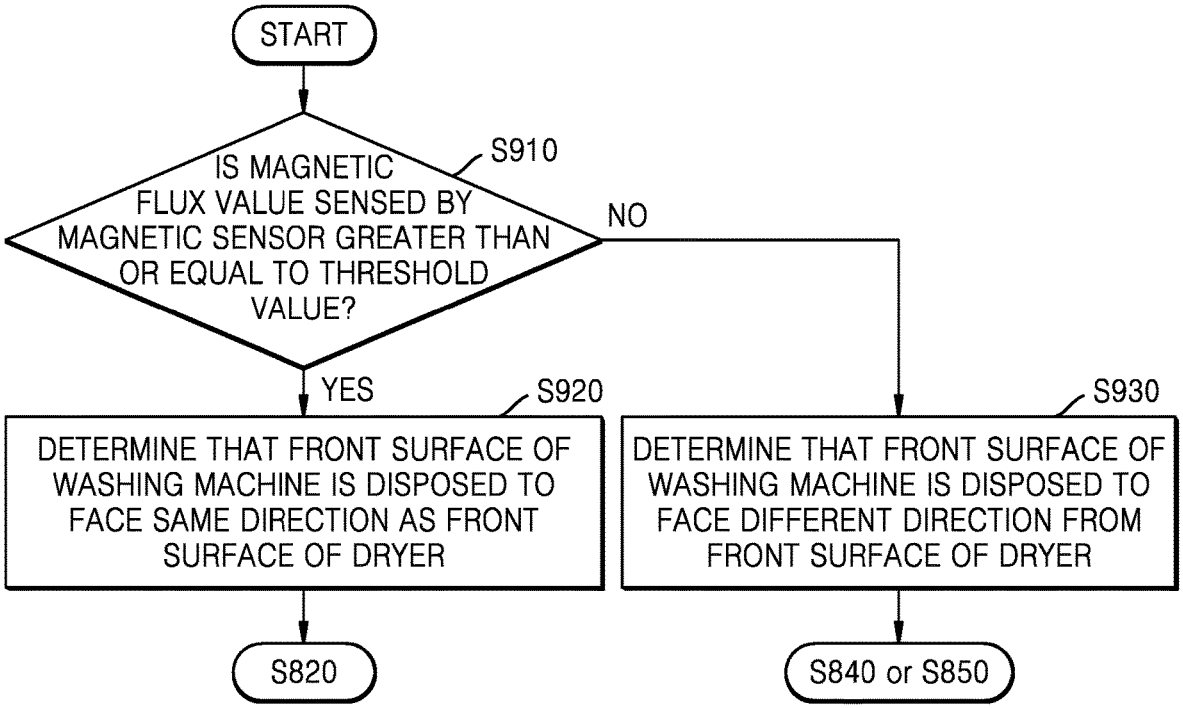
FIG. 9 is a flowchart of a method, performed by a washing machine, of identifying an arrangement direction of a dryer through a magnetic sensor, according to an embodiment of the disclosure.

FIG. 9 is a flowchart of a method, performed by a washing machine, of identifying an arrangement direction of a dryer through a magnetic sensor, according to an embodiment of the disclosure.

Referring to FIG. 9, the washing machine 1000 according to an embodiment of the disclosure may include the magnetic sensor 1400, and the dryer 2000 disposed side by side with the washing machine 1000 in a vertical or horizontal direction may include the magnetic body 2400.

In operation S910, the processor 1100 may identify whether the magnetic flux value sensed by the magnetic sensor 1400 is greater than or equal to a threshold value. For example, the processor 1100 may receive data based on the magnetic flux value of the magnetic body 2400 measured by the magnetic sensor 1400. The processor 1100 may identify whether the front surface of the dryer 2000 faces in the same direction as the front surface of the washing machine 1000, based on the data received from the magnetic sensor 1400.

In operation S920, when the magnetic flux value sensed by the magnetic sensor 1400 is greater than or equal to the threshold value, the processor 1100 may determine that the front surface of the washing machine 1000 faces in the same direction as the front surface of the dryer 2000. For example, when the front surface of the dryer 2000 faces in the same direction as the front surface of the washing machine 1000, the magnetic sensor 1400 may measure a magnetic flux value greater than or equal to the threshold value by the magnetic flux of the magnetic body 2400. The processor 1100 may determine that the front surface of the dryer 2000 faces in the same direction as the front surface of the washing machine 1000, based on reception of the data according to the magnetic flux value being greater than or equal to the threshold value. In this case, the processor 1100 may perform operation S820 of FIG. 8.

In operation S930, when it is determined that the magnetic flux value sensed by the magnetic sensor 1400 is less than the threshold value, the processor 1100 may determine that the front surface of the dryer 2000 is disposed to face a different direction from the front surface of the washing machine 1000. For example, when the magnetic sensor 1400 does not face the magnetic body 2400 within a certain distance, the magnetic flux value is less than the threshold value, and thus the processor 1100 may determine that the disposition direction of the dryer 2000 is different from the washing machine 1000. The processor 1100 may determine that the front surface of the dryer 2000 faces in a different direction from the front surface of the washing machine 1000, based on reception of the data according to the magnetic flux value being less than the threshold value. In this case, the processor 1100 may perform operation S840 or S850 of FIG. 8.

Figure 10:
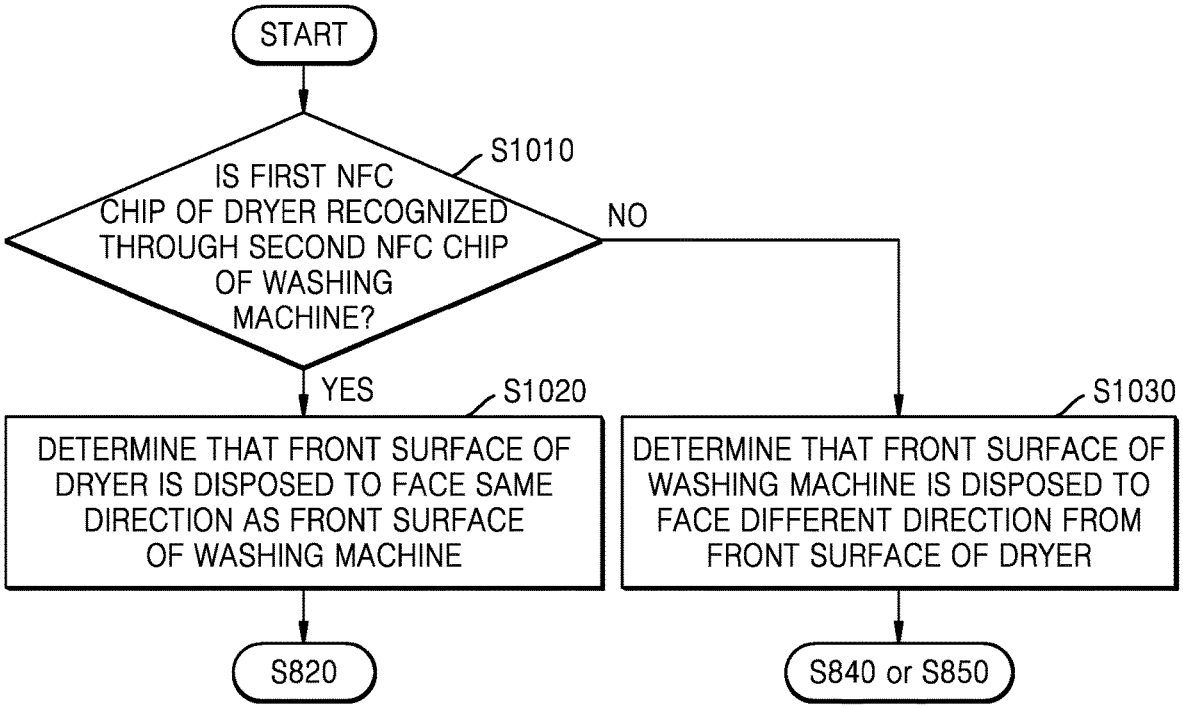
FIG. 10 is a flowchart of a method, performed by a washing machine, of identifying an arrangement direction of a dryer by using an NFC chip, according to an embodiment of the disclosure.

FIG. 10 is a flowchart of a method, performed by a washing machine, of identifying an arrangement direction of a dryer through an NFC chip, according to an embodiment of the disclosure.

Referring to FIG. 10, the washing machine 1000 according to an embodiment of the disclosure may include the second NFC chip 1500, and the dryer 2000 disposed side by side with the washing machine 1000 in a vertical or horizontal direction may include the first NFC chip 2500.

In operation S1010, the processor 1100 may identify whether the first NFC chip 2500 of the dryer 2000 is recognized through the second NFC chip 1500 of the washing machine 1000. For example, the second NFC chip 1500 may recognize the first NFC chip 2500 when the first NFC chip 2500 exists within a certain distance (e.g., approximately 5 cm). For example, when the NFC tag of the dryer 2000 is present within a certain distance from the NFC reader of the washing machine 1000, a magnetic field generated from the NFC reader may generate an induced current in a coil of the NFC tag side. When power is supplied to the NFC tag by the induced current, data contained in the NFC tag may be read by the NFC reader through radio waves. For example, when the NFC module of the dryer 2000 exists within a certain distance from the NFC module of the washing machine 1000, the NFC module of the washing machine 1000 may receive data contained in the NFC module of the dryer 2000.

In operation S1020, when the first NFC chip 2500 of the dryer 2000 is recognized through the second NFC chip 1500 of the washing machine 1000, the processor 1100 may determine that the front surface of the dryer 2000 faces in the same direction as the front surface of the washing machine 1000. In this case, the processor 1100 may perform operation S820 of FIG. 8.

In operation S1030, when the first NFC chip 2500 of the dryer 2000 is not recognized through the second NFC chip 1500 of the washing machine 1000, the processor 1100 may determine that the front surface of the dryer 2000 is disposed to face a different direction from the front surface of the washing machine 1000. In this case, the processor 1100 may perform operation S840 or S850 of FIG. 8.

A washing system 100-2 including a washing machine 1000-2 and a dryer 2000-2 according to an embodiment of the disclosure will now be described with reference to FIGS. 11 through 13.

FIG. 11 is a diagram for explaining a structure of a washing machine that identifies an arrangement direction of a dryer through a plurality of wireless communication antennas, according to an embodiment of the disclosure. FIGS. 12A and 12B are diagrams for explaining a method, performed by a washing machine, of identifying an arrangement direction of a dryer through a plurality of wireless communication antennas, according to an embodiment of the disclosure.

In a washing system 100-2 according to an embodiment of the disclosure, a washing machine 1000-2 may include a plurality of wireless communication antennas 1800. The plurality of wireless communication antennas 1800 may be formed of a conductor or conductive pattern formed on a printed circuit board (PCB). According to an embodiment of the disclosure, the plurality of wireless communication antennas 1800 may receive wireless communication signals (e.g., BLE signals or UWB signals) from an external device (e.g., the dryer 2000-2) or may transmit wireless communication signals.

The washing machine 1000-2 according to an embodiment of the disclosure may determine the location of the dryer 2000-2 by using the wireless communication signals received from the plurality of wireless communication antennas 1800. For example, the plurality of wireless communication antennas 1800 may determine the location of the dryer 2000-2 by using the wireless communication signals. The plurality of wireless communication antennas 1800 may provide data including location information of the dryer 2000-2 to a processor 1100-2. In this case, the processor 1100-2 may determine the location of the dryer 2000-2, based on data received from the plurality of wireless communication antennas 1800. According to an embodiment of the disclosure, the processor 1100-2 of the washing machine 1000-2 may determine the location of the dryer 2000-2 by using at least one of distance measurement methods based on an angle of arrival (AoA) and an angle of departure (AoD).

Referring to FIGS. 11 and 12A, a communication interface 1200-2 of the washing machine 1000-2 may be connected to the plurality of wireless communication antennas 1800 (1801 and 1802). The washing machine 1000-2 may store length (d) information between the plurality of wireless communication antennas 1800 for wireless communication in a memory. The washing machine 1000-2 may receive wireless communication signals transmitted by the antennas of the dryer 2000-2, through the plurality of wireless communication antennas 1800, respectively. The communication interface 1200-2 may obtain a phase difference between the wireless communication signals through a path difference between the wireless communication signals that have arrived from the plurality of wireless communication antennas 1800, respectively. The communication interface 1200-2 may determine AoA, which is an angle θ between the washing machine 1000-2 and the dryer 2000-2, based on the phase difference between the wireless communication signals. The communication interface 1200-2 may provide AoA data, which is direction information of the dryer 2000-2, to the processor 1100-2. The processor 1100-2 may determine the location of the dryer 2000-2, based on data received from the plurality of wireless communication antennas 1800.

Referring to FIGS. 11 and 12B, the dryer 2000-2 may include a plurality of wireless communication antennas 2800 (2801 and 2802) for transmitting the wireless communication signals. In this case, the washing machine 1000-2 according to an embodiment may include at least one wireless communication antenna for receiving a wireless communication signal. The at least one wireless communication antenna of the washing machine 1000-2 may determine AoD, which is an angle θ between the washing machine 1000-2 and the dryer 2000-2, based on a phase difference between wireless communication signals received from the plurality of wireless communication antennas 2800, respectively. The processor 1100-2 may determine the location of the dryer 2000-2, based on AoD data received from the plurality of wireless communication antennas 1800.

According to an embodiment of the disclosure, the washing machine 1000-2 may not include detection equipment, and the dryer 2000-2 may not include a detection object. The washing machine 1000-2 may ascertain the location of the dryer 2000-2, based on the at least one wireless communication antenna. The washing machine 1000-2 may identify whether a front surface of the dryer 2000-2 faces in the same direction as a front surface of the washing machine 1000-2, through the at least one wireless communication antenna. This will be described in more detail with reference to FIG. 13.

The washing machine 1000-2 of FIG. 11 may correspond to the washing machine 1000 of FIG. 2, and the washing machine 1000-2 of FIG. 11 may further include the plurality of wireless communication antennas 1800 compared to the washing machine 1000 of FIG. 2.

FIG. 13 is a flowchart of a method, performed by a washing machine, of identifying an arrangement direction of a dryer through a plurality of wireless communication antennas, according to an embodiment of the disclosure.

Referring to FIG. 13 in conjunction with FIG. 11, in operation S1310, each of the plurality of wireless communication antennas 1800 may receive a wireless communication signal transmitted by the dryer 2000-2. The wireless communication signals respectively received from the plurality of wireless communication antennas 1800 may have a phase difference. The phase difference between the wireless communication signals may be determined according to the length d between the plurality of wireless communication antennas 1800.

In operation S1320, the processor 1100-2 may determine the location of the dryer 2000-2, based on the phase difference between the wireless communication signals respectively received from the plurality of wireless communication antennas 1800. For example, the processor 1100-2 may determine AoA or AoD, which is direction information of the dryer 2000-2.

In operation S1330, the processor 1100-2 may identify whether the front surface of the dryer 2000-2 faces in the same direction as the front surface of the washing machine 1000-2. When it is determined that the front surface of the dryer 2000-2 faces in the same direction as the front surface of the washing machine 1000-2, the processor 1100-2 may control the dryer 2000-2, and a dryer control process of the washing machine 1000-2 is the same as that of FIG. 7.

According to an embodiment of the disclosure, in while the processor 1100-2 is controlling the dryer 2000-2 through wireless communication, the processor 1100-2 may output an icon indicating a 'wireless control mode' through a user interface 1300-2. However, the disclosure is not limited thereto.

Figure 14:
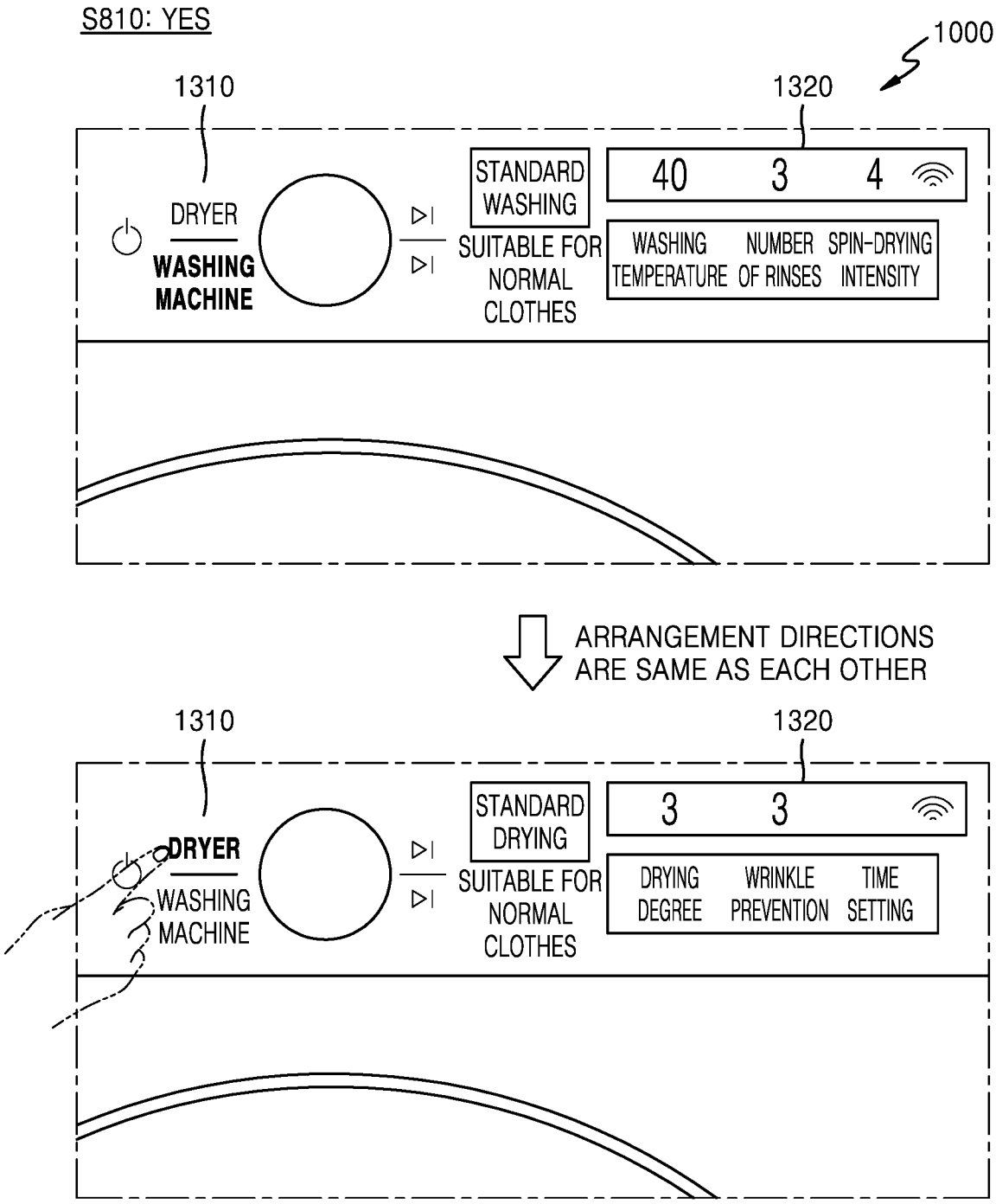
FIG. 14 is a view for explaining an operation, performed by a washing machine, of controlling a dryer when the washing machine and the dryer are arranged in a same direction, according to an embodiment of the disclosure.
Figure 15:
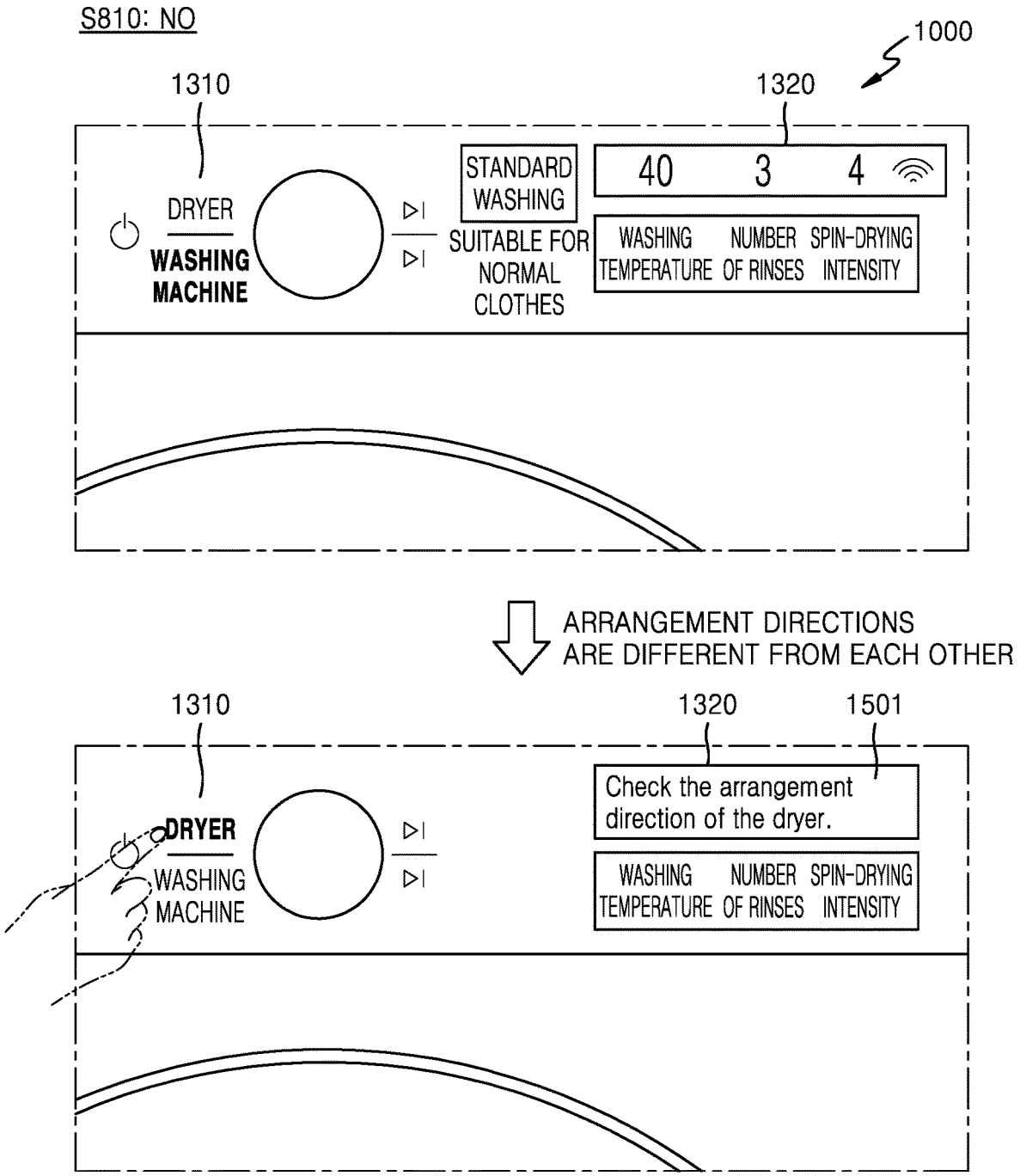
FIG. 15 is a view for explaining an operation, performed by a washing machine, of controlling a dryer when the washing machine and the dryer are arranged in different directions, according to an embodiment of the disclosure.

FIG. 14 is a view for explaining an operation, performed by a washing machine, of controlling a dryer when the washing machine and the dryer are arranged in the same direction, according to an embodiment of the disclosure. FIG. 15 is a view for explaining an operation, performed by a washing machine, of controlling a dryer when the washing machine and the dryer are arranged in different directions, according to an embodiment of the disclosure.

Referring to FIG. 14, when it is determined that the front surface of the dryer 2000 faces in the same direction as the front surface of the washing machine 1000 (S810: Yes), the washing machine 1000 may receive a user's control input related to the dryer 2000 through the user interface 1300.

The input interface 1310 of the washing machine 1000 according to an embodiment of the disclosure may include buttons related to the washing machine 1000, for example, a power button, a washing machine control activation button, a washing machine operation button, a course selection dial (or a course selection button), or a wash/rinse/spin-dry setting button. The output interface 1320 of the washing machine 1000 may output washing course information, operation time information, and the like through the display.

When it is determined that the front surface of the dryer 2000 faces in the same direction as the front surface of the washing machine 1000, the washing machine 1000 may activate the user interface 1300 related to the dryer 2000. For example, the processor 1100 may receive a user's control input regarding a dryer control activation button, a dryer operation button, a course selection dial (or a course selection button), or a drying degree/wrinkle prevention/time setting button, for example, through the input interface 1310.

The washing machine 1000 according to an embodiment of the disclosure may output operation information of the dryer 2000, for example, drying course information and operation time information, on the display through the output interface 1320.

Referring to FIG. 15, when it is determined that the front surface of the dryer 2000 face in the different direction as the front surface of the washing machine 1000 (S810: No), the washing machine 1000 may output a message for checking the direction of the dryer 2000 through the user interface 1300, or may ignore the user's control input related to the dryer 2000. For example, the processor 1100 may output a message 1501 "Check the arrangement direction of the dryer" on the output interface 1320. For example, the processor 1100 may ignore a user's control input regarding a dryer control activation button. The processor 1100 may also ignore a user's control input regarding a dryer operation button, a course selection dial (or a course selection button), or a drying degree/wrinkle prevention/time setting button, for example. The processor 1100 may inactivate the input interface 1310 related to the dryer 2000.

Figure 17:
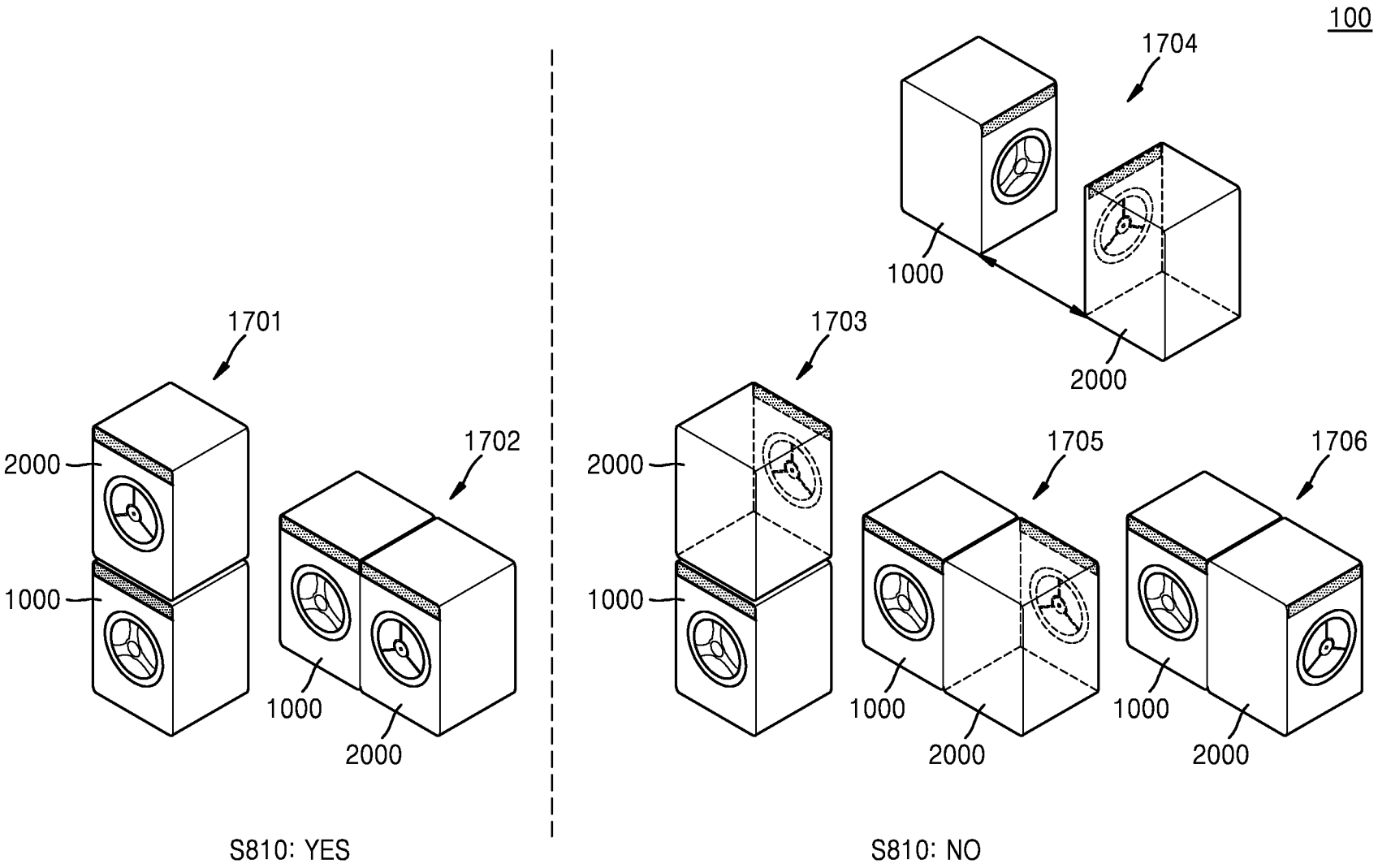
FIG. 17 illustrates various arrangement directions of a washing machine and a dryer, according to an embodiment of the disclosure.

FIG. 16 illustrates a horizontal layout structure of a washing machine and a dryer, according to an embodiment of the disclosure. FIG. 17 illustrates various arrangement directions of a washing machine and a dryer, according to an embodiment of the disclosure.

Referring to FIGS. 16 and 17, according to an embodiment of the disclosure, the washing machine 1000 may be disposed adjacent to the dryer 2000 in one direction. The one direction may be a horizontal direction or a vertical direction. For example, the laundry system 100 may have a stacking structure in which the washing machine 1000 and the dryer 2000 are disposed adjacent to each other in the vertical direction, and the washing machine 1000 and the dryer 2000 may have a parallel structure in which the washing machine 1000 and the dryer 2000 are disposed adjacent to each other in the horizontal direction.

Referring to FIG. 16, according to an embodiment of the disclosure, when the washing machine 1000 is horizontally disposed adjacent to the dryer 2000 including the magnetic body 2400, the washing machine 1000 may further include the magnetic sensor 1400 disposed adjacent to the magnetic body 2400 in the horizontal direction. The magnetic sensor 1400 of the washing machine 1000 may be disposed on the upper end thereof, and the magnetic body 2400 of the dryer 2000 may be disposed on the upper end of the dryer 2000 at a location facing the magnetic sensor 1400. Although not shown in the drawings, according to an embodiment of the disclosure, the washing machine 1000 may include the second NFC chip 1500, and the dryer 2000 may include the first NFC chip 2500.

According to an embodiment of the disclosure, when the front surface of the dryer 2000 faces in the same direction as the front surface of the washing machine 1000, the washing machine 1000 may control the dryer 2000 wirelessly. At least one processor 1100 may identify whether the front surface of the dryer 2000 faces in the same direction as the front surface of the washing machine 1000, based on the magnetic flux value sensed by the magnetic sensor 1400.

For example, the washing machine 1000 and the dryer 2000 may face in the same direction and have a stacking structure in 1701 of FIG. 17, and the washing machine 1000 and the dryer 2000 may face in the same direction and have a parallel structure in 1702 of FIG. 17. In this case, the washing machine 1000 may control the dryer 2000 wirelessly.

However, when the front surface of the washing machine 1000 and the front surface of the dryer 2000 are stacked to face in 180° different directions in 1703 of FIG. 17, when the front surface of the washing machine 1000 and the front surface of the dryer 2000 are disposed to face each other in 1704 of FIG. 17, when the front surface of the washing machine 1000 and the front surface of the dryer 2000 are arranged side by side to face in 180° different directions in 1705 of FIG. 17, and when the front surface of the washing machine 1000 and the front surface of the dryer 2000 are arranged side by side to face in 90° different directions in 1706 of FIG. 17, the washing machine 1000 may not control the dryer 2000 wirelessly.

Figure 18:
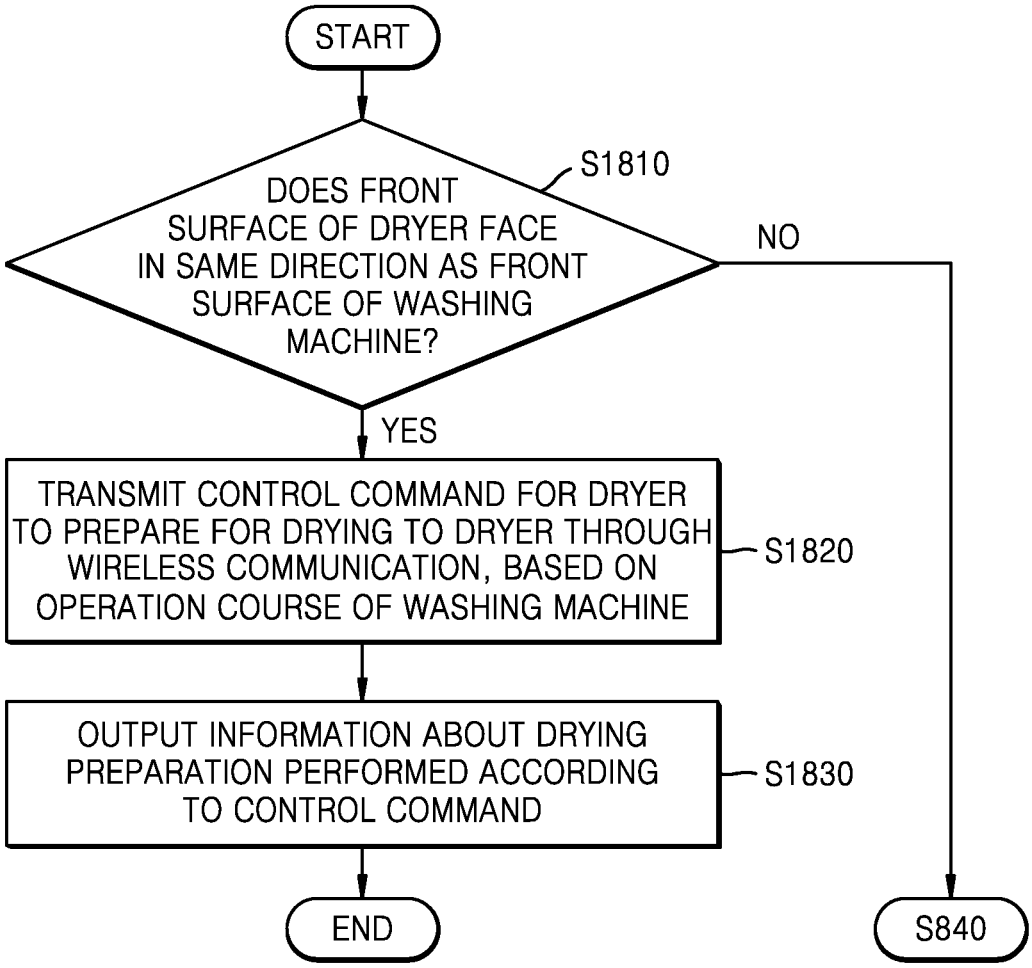
FIG. 18 is a flowchart of an operation, performed by a washing machine, of controlling a preparation operation of a dryer when the washing machine and the dryer are arranged in a same direction, according to an embodiment of the disclosure.
Figure 19:
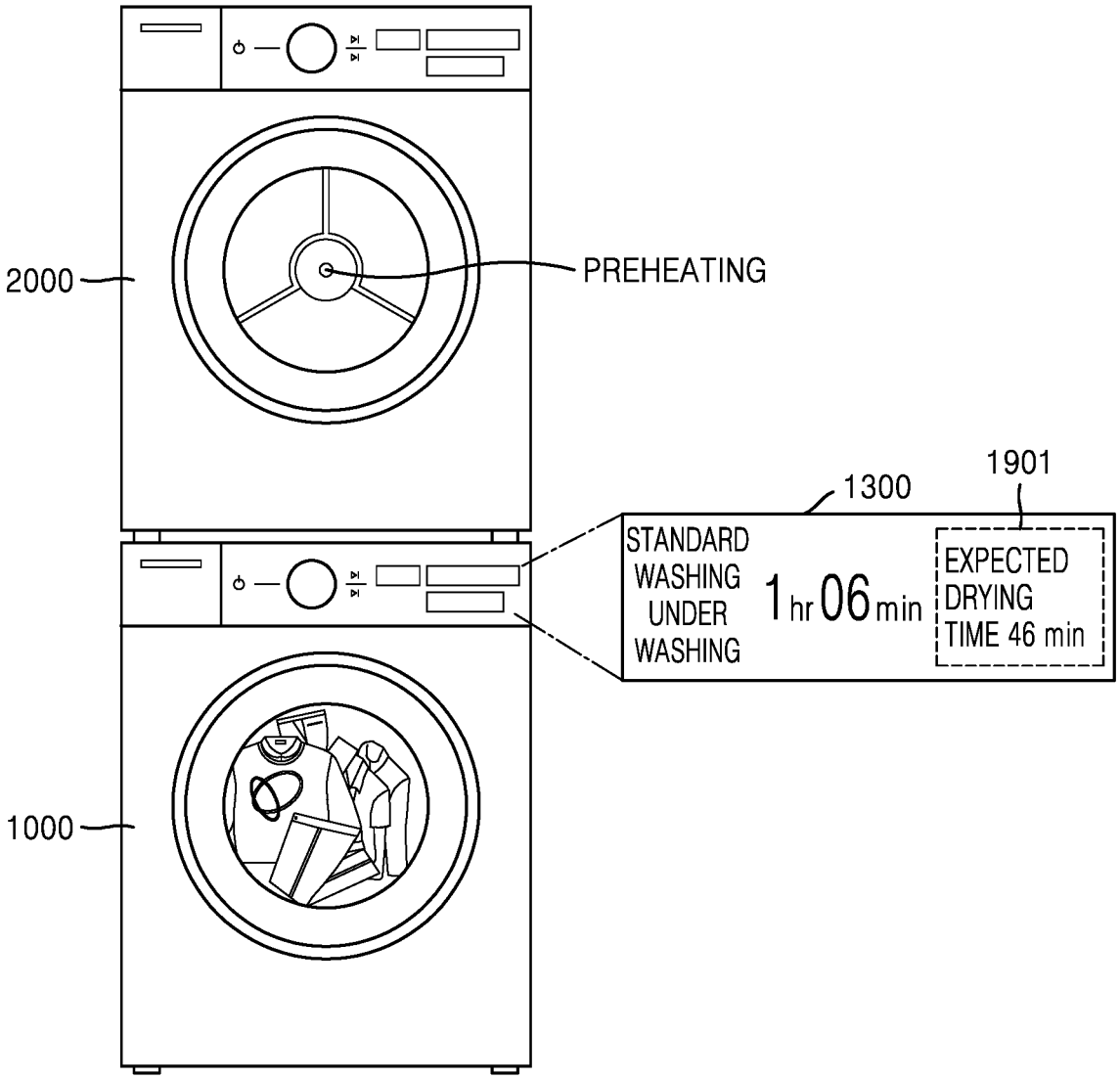
FIG. 19 is a view for explaining a method, performed by a washing machine, of controlling the preparation operation of the dryer in FIG. 18 according to an embodiment of the disclosure.

FIG. 18 is a flowchart of an operation, performed by a washing machine, of controlling a preparation operation of a dryer when the washing machine and the dryer are arranged in the same direction, according to an embodiment of the disclosure. FIG. 19 is a view for explaining a method, performed by a washing machine, of controlling the preparation operation of the dryer in FIG. 18.

Referring to FIG. 18, in operation S1810, the processor 1100 may identify whether the front surface of the dryer 2000 faces in the same direction as the front surface of the washing machine 1000. Operation S1810 may correspond to operation S810 of FIG. 8.

In operation S1820, when it is determined that the front surface of the dryer 2000 faces in the same direction as the front surface of the washing machine 1000, the processor 1100 may transmit a control command for the dryer 2000 to prepare for drying to the dryer 2000 through wireless communication, based on the operation course of the washing machine 1000. For example, referring to FIG. 19, the processor 1100 may perform an operation course of the washing machine 1000, e.g., a washing operation. The processor 1100 may receive the control input for the dryer 2000 to prepare for drying, based on the operation course of the washing machine 1000. The drying preparation may be an operation of preheating the inside of the dryer 2000 by predicting the time when the washing operation of the washing machine 1000 is finished. In this case, the user interface 1300 of the washing machine 1000 may include a drying preparation button of the dryer 2000. For example, the processor 1100 may generate a control command in response to the control input to prepare for drying, and may transmit the control command to the dryer 2000 wirelessly through the communication interface 1200.

In operation S1830, the processor 1100 may output information about the drying preparation of the dryer 2000 performed according to the control command. For example, referring to FIG. 19, the processor 1100 may output a message 1901 containing an expected drying time through the user interface 1300 according to the drying preparation. The expected drying time may be calculated based on an operation course set by the washing machine 1000, but the disclosure is not limited thereto.

According to an embodiment of the disclosure, because the washing machine 1000 is able to wirelessly control the drying preparation of the dryer 2000, a drying time may be saved, and user convenience may be improved.

Figure 20:
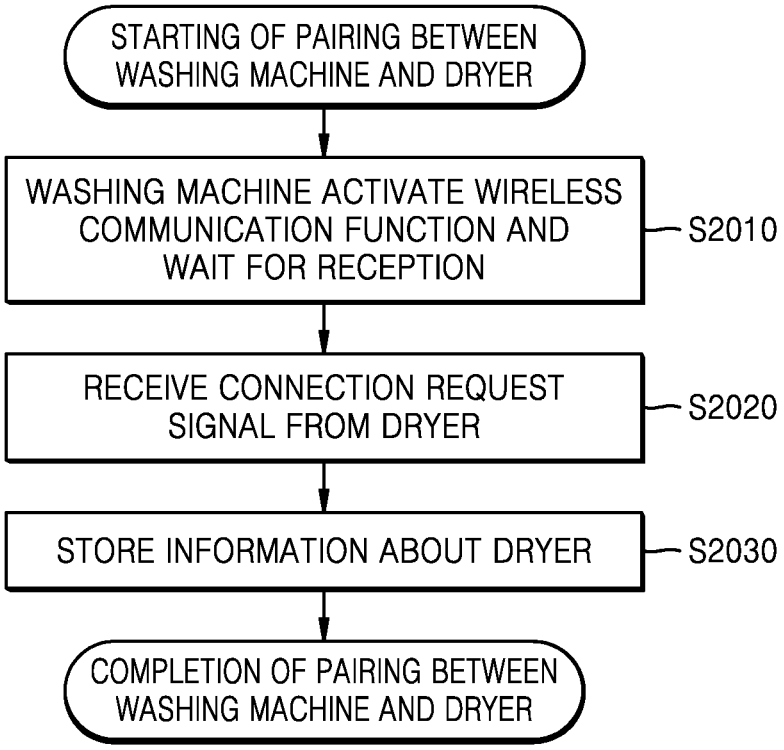
FIG. 20 is a flowchart of a method of initially pairing a washing machine with a dryer according to an embodiment of the disclosure.

FIG. 20 is a flowchart of a method, performed by a washing machine, of initially pairing with a dryer.

Referring to FIG. 20, in operation S2010, the washing machine 1000 may activate a wireless communication function and wait for reception of a signal transmitted by the dryer 2000. In operation S2020, the washing machine 1000 may receive a connection request signal from the dryer 2000. In operation S2030, the washing machine 1000 may store information about the dryer 2000 in the memory 1700.

After completing the initial pairing with the dryer 2000, the washing machine 1000 according to an embodiment of the disclosure may wirelessly communicate with the dryer 2000 through the communication interface 1200. For example, when the washing machine 1000 determines the arrangement direction of the dryer 2000 and satisfies the safety standards, the user may wirelessly control the operation of the dryer 2000 through the user interface of the washing machine 1000.

The washing machine 1000 for controlling the dryer 2000, according to an embodiment of the disclosure, may include the communication interface 1200 for wirelessly communicating with the dryer 2000, the user interface 1300 for receiving a user's control input related to the dryer 2000 and outputting information related to the dryer 2000, and the at least one processor 1100. The at least one processor 1100 may identify whether the front surface of the dryer 2000 faces in the same direction as the front surface of the washing machine 1000. When it is determined that the front surface of the dryer 2000 faces in the same direction as the front surface of the washing machine 1000, and the processor 1100 receives a user's control input related to the dryer 2000 through the user interface 1300, the processor 1100 may transmit a control command corresponding to the user's control input related to the dryer 2000 to the dryer 2000 through the communication interface 1200.

According to an embodiment of the disclosure, because the washing machine 1000 is able to wirelessly control the dryer 2000 according to the safety standards, user convenience may be improved.

When the dryer 2000 including the magnetic body 2400 on its lower end is stacked on the washing machine 1000, the washing machine 1000 may further include the magnetic sensor 1400 at the location corresponding to the magnetic body 2400 on the upper end of the washing machine 1000. The at least one processor 1100 may identify whether the front surface of the dryer 2000 faces in the same direction as the front surface of the washing machine 1000, based on the magnetic flux value sensed by the magnetic sensor 1400.

When it is determined that the magnetic flux value sensed by the magnetic sensor 1400 is equal to or greater than the threshold value, the at least one processor 1100 may determine that the front surface of the dryer 2000 faces in the same direction as the front surface of the washing machine 1000, and, when it is determined that the magnetic flux value sensed by the magnetic sensor 1400 is less than the threshold value, the at least one processor 1100 may determine that the front surface of the dryer 2000 is disposed to face a different direction from the front surface of the washing machine 1000.

The magnetic sensor 1400 may be arranged at a location having a non-metallic material on the upper end of the washing machine 1000.

The magnetic sensor 1400 may include a reed switch, a TMR sensor, a Hall sensor, etc.

When the dryer 2000 including the first NFC chip 2500 on its lower end is stacked on the washing machine 1000, the washing machine 1000 may further include the second NFC chip 1500 at the location corresponding to the first NFC chip 2500 on the upper end of the washing machine 1000. By recognizing the first NFC chip 2500 arranged on the lower end of the dryer 2000 by using the second NFC chip 1500, the at least one processor 1100 may identify whether the front surface of the dryer 2000 faces in the same direction as the front surface of the washing machine 1000.

The first NFC chip 2500 may include one of an NFC tag and an NFC module, and the second NFC chip 1500 may include one of an NFC reader and an NFC module.

The washing machine 1000 may include the plurality of wireless communication antennas 1800 respectively receiving wireless communication signals transmitted by the dryer 2000 and transmitting the received wireless communication signals to the at least one processor 1100. The at least one processor 1100 may identify whether the front surface of the dryer 2000 faces in the same direction as the front surface of the washing machine 1000, based on the phase difference between the wireless communication signals respectively received from the plurality of wireless communication antennas 1800.

When it is determined that the front surface of the dryer 2000 faces in the same direction as the front surface of the washing machine 1000, the at least one processor 1100 may transmit a control command for the dryer 2000 to prepare for drying to the dryer 2000 through the communication interface 1200, based on the operation course of the washing machine 1000.

The at least one processor 1100 may output information about the drying preparation of the dryer 2000 performed according to the control command through the user interface 1300.

When it is determined that the front surface of the dryer 2000 is disposed to face a different direction from the front surface of the washing machine 1000, the at least one processor 1100 may perform at least one of an operation of outputting a message for checking the direction of the dryer 2000 through the user interface 1300 or an operation of ignoring a user's control input related to the dryer 2000 received through the user interface 1300.

The at least one processor 1100 may receive operation information of the dryer 2000 through the communication interface 1200, and may output the operation information of the dryer 2000 through the user interface 1300.

When the washing machine 1000 is disposed adjacent to the dryer 2000 including the magnetic body 2400 in one direction, the washing machine 1000 may further include the magnetic sensor 1400 disposed adjacent to the magnetic body 2400 in the one direction. The at least one processor 1100 may identify whether the front surface of the dryer 2000 faces in the same direction as the front surface of the washing machine 1000, based on the magnetic flux value sensed by the magnetic sensor 1400.

A method, performed by the washing machine 1000, of controlling the dryer 2000, according to an embodiment of the disclosure may include an operation of identifying whether the front surface of the dryer 2000 faces in the same direction as the front surface of the washing machine 1000, an operation of, when it is determined that the front surface of the dryer 2000 faces in the same direction as the front surface of the washing machine 1000, generating a control command corresponding to the user's control input related to the dryer 2000, in response to the user's control input related to the dryer 2000, and an operation of transmitting the control command to the dryer 2000 through wireless communication.

According to an embodiment of the disclosure, because the washing machine 1000 is able to wirelessly control the dryer 2000 according to the safety standards, user convenience may be improved.

When the dryer 2000 including the magnetic body 2400 on its lower end is stacked on the washing machine 1000, the washing machine 1000 may include the magnetic sensor 1400 at the location corresponding to the magnetic body 2400 on the upper end of the washing machine 1000. The operation of identifying whether the front surface of the dryer 2000 faces in the same direction as the front surface of the washing machine 1000 may include identifying whether the front surface of the dryer 2000 faces in the same direction as the front surface of the washing machine 1000, based on the magnetic flux value sensed by the magnetic sensor 1400.

The operation of identifying whether the front surface of the dryer 2000 faces in the same direction as the front surface of the washing machine 1000 may include, when it is determined that the magnetic flux value sensed by the magnetic sensor 1400 is equal to or greater than the threshold value, determining that the front surface of the dryer 2000 faces in the same direction as the front surface of the washing machine 1000, and, when it is determined that the magnetic flux value sensed by the magnetic sensor 1400 is less than the threshold value, determining that the front surface of the dryer 2000 is disposed to face a different direction from the front surface of the washing machine 1000.

When the dryer 2000 including the first NFC chip 2500 on its lower end is stacked on the washing machine 1000, the washing machine 1000 may include the second NFC chip 1500 at the location corresponding to the first NFC chip 2500 on the upper end of the washing machine 1000. The operation of identifying whether the front surface of the dryer 2000 faces in the same direction as the front surface of the washing machine 1000 may include identifying whether the front surface of the dryer 2000 faces in the same direction as the front surface of the washing machine 1000, by recognizing the first NFC chip 2500 arranged on the lower end of the dryer 2000 by using the second NFC chip 1500.

The washing machine 1000 may include the plurality of wireless communication antennas 1800 respectively receiving wireless communication signals transmitted by the dryer 2000. The operation of identifying whether the front surface of the dryer 2000 faces in the same direction as the front surface of the washing machine 1000 may include identifying whether the front surface of the dryer 2000 faces in the same direction as the front surface of the washing machine 1000, based on the phase difference between the wireless communication signals respectively received from the plurality of wireless communication antennas 1800.

The method, performed by the washing machine 1000, of controlling the dryer 2000, may further include, when it is determined that the front surface of the dryer 2000 faces in the same direction as the front surface of the washing machine 1000, transmitting a control command for the dryer 2000 to prepare for drying to the dryer 2000 through wireless communication, based on the operation course of the washing machine 1000.

The method, performed by the washing machine 1000, of controlling the dryer 2000, may include at least one of an operation of, when it is determined that the front surface of the dryer 2000 faces in a different direction from the front surface of the washing machine 1000, outputting a message for checking the direction of the dryer 2000 or an operation of ignoring a user's control input related to the dryer 2000.

The machine-readable storage medium may be provided as a non-transitory storage medium. The 'non-transitory storage medium' is a tangible device and only means that it does not contain a signal (e.g., electromagnetic waves). This term does not distinguish a case in which data is stored semi-permanently in a storage medium from a case in which data is temporarily stored. For example, the non-transitory recording medium may include a buffer in which data is temporarily stored.

According to an embodiment of the disclosure, a method according to various disclosed embodiments may be provided by being included in a computer program product. The computer program product, which is a commodity, may be traded between sellers and buyers. Computer program products are distributed in the form of device-readable storage media (e.g., compact disc read only memory (CD-ROM)), or may be distributed (e.g., downloaded or uploaded) through an application store or between two user devices (e.g., smartphones) directly and online. In the case of online distribution, at least a portion of the computer program product (e.g., a downloadable app) may be stored at least temporarily in a device-readable storage medium, such as a memory of a manufacturer's server, a server of an application store, or a relay server, or may be temporarily generated.

What is claimed is:

1. A washing machine comprising:

a communication interface for wireless communication with a dryer;

a user interface configured to receive a user's control input related to the dryer, and to output information related to the dryer; and at least one processor configured to:

determine whether a front surface of the dryer faces in a same direction as a front surface of the washing machine, and when it is determined that the front surface of the dryer faces in the same direction as the front surface of the washing machine, receive the user's control input related to the dryer through the user interface and transmit, to the dryer, a control command corresponding to the user's control input related to the dryer through the communication interface.

2. The washing machine of claim 1, wherein the washing machine further comprises:

a magnetic sensor arranged on an upper end of the washing machine at a location that corresponds to a magnetic body on a lower end of the dryer when the dryer is stacked on the washing machine, and the at least one processor is further configured to determine whether the front surface of the dryer faces in the same direction as the front surface of the washing machine based on a magnetic flux value sensed by the magnetic sensor.

3. The washing machine of claim 2, wherein the at least one processor is further configured to:

when the magnetic flux value sensed by the magnetic sensor is equal to or greater than a threshold value, determine that the front surface of the dryer faces in the same direction as the front surface of the washing machine, and when the magnetic flux value sensed by the magnetic sensor is less than the threshold value, determine that the front surface of the dryer faces in a different direction from the front surface of the washing machine.

4. The washing machine of claim 2, wherein the location at which the magnetic sensor is arranged on the upper end of the washing machine includes a non-metallic material.

5. The washing machine of claim 2, wherein the magnetic sensor includes at least one of a reed switch, a tunnel magnetoresistance (TMR) sensor, and a Hall sensor.

6. The washing machine of claim 1, wherein the washing machine further comprises:

a first near field communication (NFC) chip arranged on an upper end of the washing machine at a location that corresponds to a second NFC chip on a lower end of the dryer when the dryer is stacked on the washing machine, and the at least one processor is further configured to determine whether the front surface of the dryer faces in the same direction as the front surface of the washing machine based on whether the first NFC chip recognizes the second NFC chip.

7. The washing machine of claim 6, wherein the first NFC chip includes one of an NFC reader and an NFC module, and the second NFC chip comprises one of an NFC tag and an NFC module.

8. The washing machine of claim 1, wherein the washing machine further comprises:

a plurality of wireless communication antennas configured to respectively receive wireless communication signals transmitted by the dryer, and transmit the received wireless communication signals to the at least one processor, and the at least one processor is further configured to determine whether the front surface of the dryer faces in the same direction as the front surface of the washing machine based on a phase difference between the wireless communication signals respectively received from the plurality of wireless communication antennas.

9. The washing machine of claim 1, wherein when it is determined that the front surface of the dryer faces in the same direction as the front surface of the washing machine, the at least one processor is further configured to transmit a control command through the communication interface, to the dryer, for the dryer to prepare for drying, based on an operation course of the washing machine.

10. The washing machine of claim 9, wherein the at least one processor is further configured to output information, through the user interface, about the preparation for drying performed by the dryer according to the control command.

11. The washing machine of claim 1, wherein when it is determined that the front surface of the dryer faces in a different direction from the front surface of the washing machine, the at least one processor is further configured to perform at least one of an operation of outputting a message through the user interface for checking a direction of the dryer, and an operation of ignoring the user's control input related to the dryer received through the user interface.

12. The washing machine of claim 1, wherein the at least one processor is further configured to receive operation information of the dryer through the communication interface and output the operation information of the dryer through the user interface.

13. The washing machine of claim 1, wherein the washing machine further comprises:

a magnetic sensor arranged to be adjacent to a magnetic body arranged on the dyer when the washing machine is disposed adjacent to the dryer in one direction, and the at least one processor is further configured to identify whether the front surface of the dryer faces in the same direction as the front surface of the washing machine based on a magnetic flux value sensed by the magnetic sensor.

14. A method performed by a washing machine, the method comprising:

determining whether a front surface of a dryer faces in a same direction as a front surface of the washing machine; and when it is determined that the front surface of the dryer faces in the same direction as the front surface of the washing machine:

receiving a user's control input related to the dryer through a user interface of the washing machine, and transmitting, to the dryer, a control command corresponding to the user's control input related to the dryer through a communication interface of the washing machine.

15. The method of claim 14, wherein the washing machine includes a magnetic sensor arranged on an upper end of the washing machine at a location corresponding to a magnetic body on a lower end of the dryer when the dryer is stacked on the washing machine, and the determining of whether the front surface of the dryer faces in the same direction as the front surface of the washing machine is based on a magnetic flux value sensed by the magnetic sensor.

16. The method of claim 15, further comprising:

when the magnetic flux value sensed by the magnetic sensor is equal to or greater than a threshold value, determining that the front surface of the dryer faces in the same direction as the front surface of the washing machine; and when the magnetic flux value sensed by the magnetic sensor is less than the threshold value, determining that the front surface of the dryer faces in a different direction from the front surface of the washing machine.

17. The method of claim 14, wherein the washing machine includes a first near field communication (NFC) chip on an upper end of the washing machine at a location that corresponds to a second NFC chip on a lower end of the dryer when the dryer is stacked on the washing machine, and the determining of whether the front surface of the dryer faces in the same direction as the front surface of the washing machine includes determining whether the first NFC chip recognizes the second NFC chip.

18. The method of claim 14, wherein the washing machine includes a plurality of wireless communication antennas configured to respectively receive wireless communication signals transmitted by the dryer, and the determining of whether the front surface of the dryer 2000 faces in the same direction as the front surface of the washing machine is based on a phase difference between the wireless communication signals respectively received from the plurality of wireless communication antennas.

19. The method of claim 14, wherein when it is determined that the front surface of the dryer faces in the same direction as the front surface of the washing machine, the method further comprises transmitting a control command through the communication interface, to the dryer, for the dryer to prepare for drying, based on an operation course of the washing machine.

20. The method of claim 14, wherein when it is determined that the front surface of the dryer faces in a different direction from the front surface of the washing machine, the method further comprises at least one of an operation of outputting a message through the user interface for checking a direction of the dryer, and an operation of ignoring the user's control input related to the dryer received through the user interface.

* * * * *